US007382273B2

(12) United States Patent
Hall et al.

(10) Patent No.: US 7,382,273 B2
(45) Date of Patent: Jun. 3, 2008

(54) WIRED TOOL STRING COMPONENT

(76) Inventors: David R. Hall, 2185 S. Larsen Pkwy., Provo, UT (US) 84606; Scott Dahlgren, 2185 S. Larsen Pkwy., Provo, UT (US) 84606; Paul Schramm, 2185 S. Larsen Pkwy., Provo, UT (US) 84606

( * ) Notice: Subject to any disclaimer, the term of this patent is extended or adjusted under 35 U.S.C. 154(b) by 182 days.

(21) Appl. No.: 11/421,357

(22) Filed: May 31, 2006

(65) Prior Publication Data

US 2006/0260801 A1 Nov. 23, 2006

Related U.S. Application Data

(63) Continuation-in-part of application No. 11/133,905, filed on May 21, 2005, now Pat. No. 7,277,026.

(51) Int. Cl.
*G01V 3/00* (2006.01)

(52) U.S. Cl. ..... 340/854.8; 340/855.1; 340/855.2; 175/40

(58) Field of Classification Search ..... 340/854.8, 340/855.1, 855.2; 175/40
See application file for complete search history.

(56) References Cited

U.S. PATENT DOCUMENTS

| | | | | |
|---|---|---|---|---|
| 2,414,719 | A | 1/1947 | Cloud | |
| 3,967,201 | A | 6/1976 | Rorden | |
| 4,416,494 | A | 11/1983 | Watkins | |
| 4,785,247 | A | 11/1988 | Meador et al. | |
| 4,788,544 | A * | 11/1988 | Howard | 340/853.7 |
| 4,806,928 | A | 2/1989 | Vereruso | |
| 6,123,561 | A * | 9/2000 | Turner et al. | 439/194 |
| 6,392,317 | B1 | 5/2002 | Hall | |
| 6,670,880 | B1 | 12/2003 | Hall | |
| 6,688,396 | B2 * | 2/2004 | Floerke et al. | 166/380 |
| 6,717,501 | B2 | 4/2004 | Hall | |
| 6,799,632 | B2 | 10/2004 | Hall | |
| 6,821,147 | B1 | 11/2004 | Hall | |
| 6,830,467 | B2 | 12/2004 | Hall | |
| 6,844,498 | B2 | 1/2005 | Hall | |
| 6,888,473 | B1 | 5/2005 | Hall | |
| 6,945,802 | B2 | 5/2005 | Hall | |
| 6,913,093 | B2 | 7/2005 | Hall | |
| 6,929,493 | B2 | 8/2005 | Hall | |
| 6,968,611 | B2 | 11/2005 | Hall | |
| 2002/0135179 | A1 * | 9/2002 | Boyle et al. | 285/21.1 |
| 2004/0104797 | A1 | 6/2004 | Hall | |
| 2004/0113808 | A1 | 6/2004 | Hall | |
| 2004/0145492 | A1 | 7/2004 | Hall | |

(Continued)

OTHER PUBLICATIONS

U.S. Appl. No. 11/133,905, filed May 21, 2005, Hall.

*Primary Examiner*—Timothy Edwards, Jr.
(74) *Attorney, Agent, or Firm*—Tyson J. Wilde; Benjamin T. Miskin

(57) ABSTRACT

An apparatus is disclosed as having a downhole string component having first and second ends. The first end has first and second signal couplers, and the second end has third and fourth signal couplers. An electrical conductor is in electrical communication with the first, second, third, and fourth signal couplers. The first and third signal couplers have a first band pass filter with a first resonant frequency and the second and fourth signal couplers have a second band pass filter with a second resonant frequency.

20 Claims, 20 Drawing Sheets

U.S. PATENT DOCUMENTS

2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall
2005/0001735 A1 1/2005 Hall
2005/0001736 A1 1/2005 Hall
2005/0001738 A1 1/2005 Hall
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 7/2005 Hall
2005/0161215 A1 7/2005 Hall
2005/0173128 A1 8/2005 Hall
2005/0212530 A1 9/2005 Hall
2005/0236160 A1 10/2005 Hall
2005/0284662 A1 12/2005 Hall
2007/0017671 A1* 1/2007 Clark et al. ..... 166/248

* cited by examiner

WIRED TOOL STRING COMPONENT

CROSS REFERENCE TO RELATED APPLICATIONS

This application is a continuation-in-part of U.S. application Ser. No. 11/133,905 filed on May 21, 2005 now U.S. Pat. No. 7,277,026 and entitled, "Downhole Component with Multiple Transmission Elements." U.S. application Ser. No. 11/133,905 is herein incorporated by reference for all that it discloses.

BACKGROUND OF THE INVENTION

As downhole instrumentation and tools have become increasingly more complex in their composition and versatile in their functionality, the need to transmit power and/or data through tubular tool string components is becoming ever more significant. Real-time logging tools located at a drill bit and/or throughout a tool string require power to operate. Providing power downhole is challenging, but if accomplished it may greatly increase the efficiency of drilling. Data collected by logging tools are even more valuable when they are received at the surface real time.

The goal of transmitting power or data through downhole tool string components is not new. Throughout recent decades, many attempts have been made to provide high-speed data transfer or usable power transmission through tool string components. One technology developed involves using inductive couplers to transmit an electric signal across a tool joint. U.S. Pat. No. 2,414,719 to Cloud discloses an inductive coupler positioned within a downhole pipe to transmit a signal to an adjacent pipe.

U.S. Pat. No. 4,785,247 to Meador discloses an apparatus and method for measuring formation parameters by transmitting and receiving electromagnetic signals by antennas disposed in recesses in a tubular housing member and including apparatus for reducing the coupling of electrical noise into the system resulting from conducting elements located adjacent the recesses and housing.

U.S. Pat. No. 4,806,928 to Veneruso describes a downhole tool adapted to be coupled in a pipe string and positioned in a well that is provided with one or more electrical devices cooperatively arranged to receive power from surface power sources or to transmit and/or receive control or data signals from surface equipment. Inner and outer coil assemblies arranged on ferrite cores are arranged on the downhole tool and a suspension cable for electromagnetically coupling the electrical devices to the surface equipment is provided.

U.S. Pat. No. 6,670,880 to Hall also discloses the use of inductive couplers in tool joints to transmit data or power through a tool string. The '880 patent teaches of having the inductive couplers lying in magnetically insulating, electrically conducting troughs. The troughs conduct magnetic flux while preventing resultant eddy currents. U.S. Pat. No. 6,670,880 is herein incorporated by reference for all that it discloses.

U.S. patent application Ser. No. 11/133,905, also to Hall, discloses a tubular component in a downhole tool string with first and second inductive couplers in a first end and third and fourth inductive couplers in a second end. A first conductive medium connects the first and third couplers and a second conductive medium connects the second and fourth couplers. The first and third couplers are independent of the second and fourth couplers. Application Ser. No. 11/133,905 is herein incorporated by reference for all that it discloses.

BRIEF SUMMARY OF THE INVENTION

In one aspect of the invention, an apparatus comprises a tubular tool string component having first and second ends. The first end comprises first and second signal couplers, and the second end comprises third and fourth signal couplers. The signal couplers may be inductive couplers. In some embodiments, at least some of the inductive couplers are disposed within a magnetically conductive, electrically insulating trough. An electrical conductor is in electrical communication with the first, second, third, and fourth signal couplers. The electrical conductor may be selected from the group consisting of coaxial cables, shielded coaxial cables, twisted pairs of wires, triaxial cables, and biaxial cables. The first and third signal couplers may comprise a first band pass filter with a first resonant frequency and the second and fourth signal couplers comprise a second band pass filter with a second resonant frequency.

The apparatus may be adapted to transmit a data signal from the first signal coupler through the electrical conductor to the third signal coupler. The first band pass filter of the first coupler allows frequencies at or about at the first resonant frequency to pass through, while blocking other frequencies.

The apparatus may also be adapted to transmit a signal at a different frequency from the second coupler through the electrical conductor to the fourth signal coupler. In some embodiments, it may be advantageous to send power at a lower frequency than data, which may be a driving factor in providing the different sets of couplers adapted to transmit signals of varying frequency. The power signal may be supplied by batteries, a downhole generator, another tubular tool string component, or combinations thereof. The second band pass filter allows frequencies at the second resonant frequency to pass through, while blocking other frequencies. Therefore, the power signal may be transmitted at or about at the second resonant frequency.

In some embodiments, one or both of the band pass filters arise from the inherent characteristics of the electrical conductor and signal couplers, such as the inherent capacitance, resistance, and inductance. In other embodiments at least one of the band pass filters may comprise inductors, capacitors, resistors, active filters, passive filters, integrated circuit filters, crystal filters, or combinations thereof. Alternatively, both sets of couplers may be configured to transmit either two data signals or two power signals.

Electronic circuitry may also be disposed within the downhole component. The electronic circuitry may be in communication with the electrical conductor.

In accordance with another aspect of the invention, a downhole tool comprises a groove formed in and proximate an end of the downhole tool. The downhole tool may be a drill pipe, a production pipe, a drill collar, a heavy weight pipe, a reamer, a bottom-hole assembly component, a tool string component, a jar, a hammer, a swivel, a drill bit, a sensor, a sub, or a combination thereof.

In some embodiments, a magnetically conductive material is disposed in the groove and comprises a first and second trough. In some embodiments the magnetically conductive material is also electrically insulating. A first electrically conductive coil is disposed within the first trough and comprises a first geometry adapted to transmit a signal at a first optimal frequency. A second electrically conductive coil is disposed within the second trough and comprises a second geometry adapted to transmit a signal at a second optimal frequency.

In some embodiments, the first and second geometries may differ in their number of turns, diameter, type of material, surface area, length, or combinations thereof. The first trough may be narrower and/or shallower than the second trough. The magnetically conductive electrically insulating material may comprise a different permeability proximate the first trough than proximate the second trough.

In accordance with another aspect of the invention, a downhole tool string comprises a first wired component having a first inductive coupler proximate a pin end and a second wired component having a second inductive coupler proximate a box end. The pin end of the first component is threadedly connected within the box end of the second component such that the first and second inductive couplers are adjacent one another. Each coupler has a magnetically conductive material with a first coil disposed within a first trough formed in the magnetic material and a second coil disposed within a second trough also formed in the magnetic material. The first coils of both the pin and box ends comprise a first geometry adapted to transmit a signal at a first frequency and the second coils of both the pin and box ends comprise a second geometry adapted to transmit signals at a different frequency.

The downhole tool string may further comprise a power source in the first wired component. An electrical device disposed within the second wired component may be in communication with the power source through the first coils, the second coils, or combinations thereof.

In another aspect of the invention, an apparatus comprises a downhole tool string component having a first end and a second end. First and second sets of magnetically conductive, electrically insulating troughs are disposed within the first and second ends of the downhole component, respectively. Each set of troughs comprise both an electrical coil adapted for data transmission and another coil adapted for power transmission lying therein. An electrical conductor comprises a first end in electrical communication with both coils of the first set and a second end in electrical communication with both coils of the second set.

The magnetically conductive, electrically insulating troughs may comprise ferrite, iron, mu-metals, nickel, or combinations thereof. Each magnetically conductive, electrically insulating trough may also be disposed within a shoulder at the end of the downhole component.

In some embodiments, a data signal may be transmitted through the electrical conductor at a first frequency and a power signal may be transmitted through the electrical conductor at a second frequency. In such embodiments, at least one of the coils may comprise a frequency filter. The data transmission coil may comprise a single turn while the power coupler may comprise a plurality of turns.

DETAILED DESCRIPTION OF THE INVENTION AND THE PREFERRED EMBODIMENT

Figure 1:
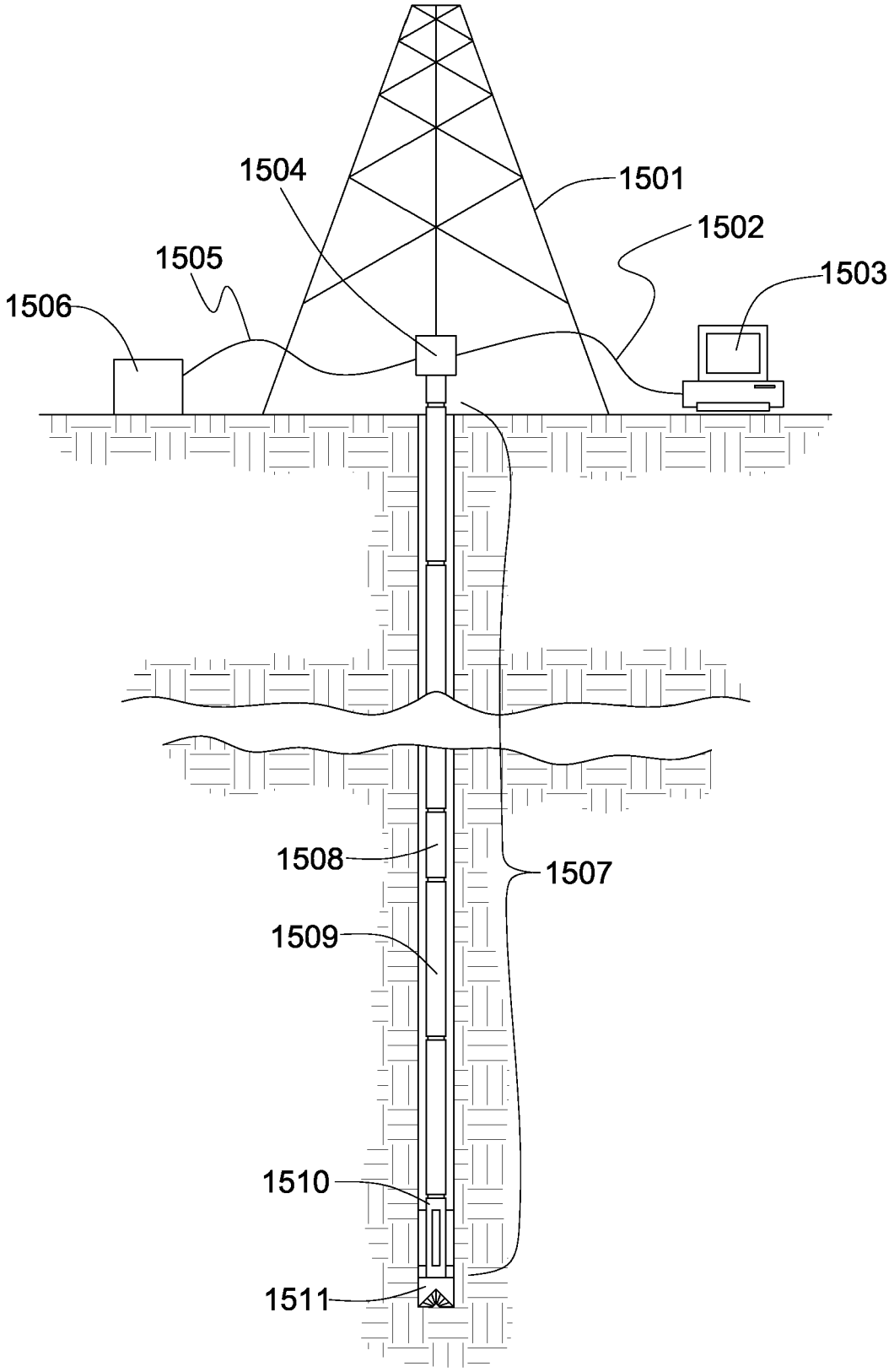
FIG. 1 is a perspective view of an embodiment of a drill site.

FIG. 1 is a perspective view of a drill rig 1501 and a downhole tool string 1507 which may incorporate the present invention. The downhole tool string 1507 comprises a drill bit 1511, a bottom-hole assembly 1510, drill pipe 1509, a sub 1508, and a swivel 1504. Preferably, the tool string comprises a two-way telemetry system for data and/or power transmission. The swivel 1504 may be connected via cables 1502, 1505 to surface equipment 1503, 1506 such as a computer 1503 or a generator 1506. A swivel 1504 may be advantageous, as it may be an interface for data transfer from a rotating tool string 1507 to stationary surface equipment 1503, 1506. In some embodiments, the generator 1506 may provide power to the tool string 1507, and the downhole components 1508, 1509, 1510, although the power may also be stored or generated downhole.

Figure 2:
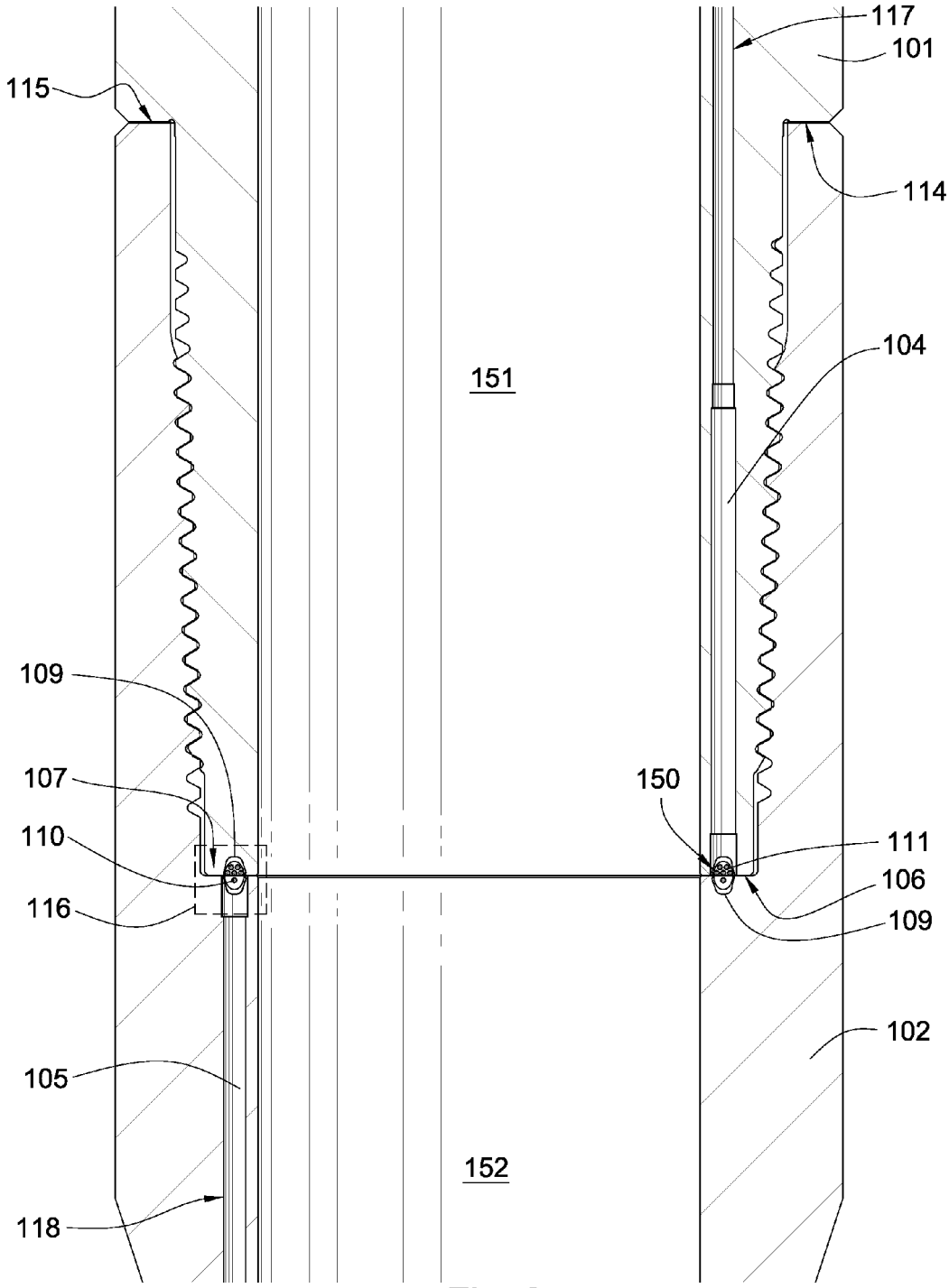
FIG. 2 is a cross sectional diagram of an embodiment of first and second tools threadedly connected.

Referring to FIG. 2, discloses a telemetry system for transmitting an electrical signal between threadedly connected first and second wired tubular tool string components 101, 102. Each component 101, 102 may comprise at least one signal coupler 150 disposed within grooves 109 formed in its secondary shoulders 107, 106. The signal couplers 150 may be inductive couplers comprising electrically conductive coils 111, 110. The inductive couplers may be in electrical communication with electrical conductors 104, 105.

The tool string components 101, 102 may be selected from the group consisting of drill pipe, production pipe, drill collars, heavy weight pipe, reamers, bottom-hole assembly components, tool string components, jars, hammers, swivels, drill bits, sensors, subs, and combinations thereof.

The tool string components 101, 102 may comprise at least two shoulders, primary 115, 114 and secondary 107, 106 shoulders. The primary shoulders 115, 114 support the majority of the make-up torque and also the load of the tool string. The secondary shoulders 107, 106 are located internally with respect to the primary shoulder 115, 114 and are designed to support any overloads experienced by the tool joints. There may be gun-drilled holes 117, 118 extending from the grooves 109 to the bores 151, 152 of the tool string components 101, 102. At least a portion of electrical conductors 104, 105 may be secured within the holes 117, 118. This may be accomplished by providing the holes 117, 118 with at least two diameters such that the narrower diameter of each hole grips a wider portion of the electrical conductors 104, 105. The electrical conductors 104, 105 may be selected from the group consisting of coaxial cables, shielded coaxial cables, twisted pairs of wire, triaxial cables, and biaxial cables.

Figure 3:
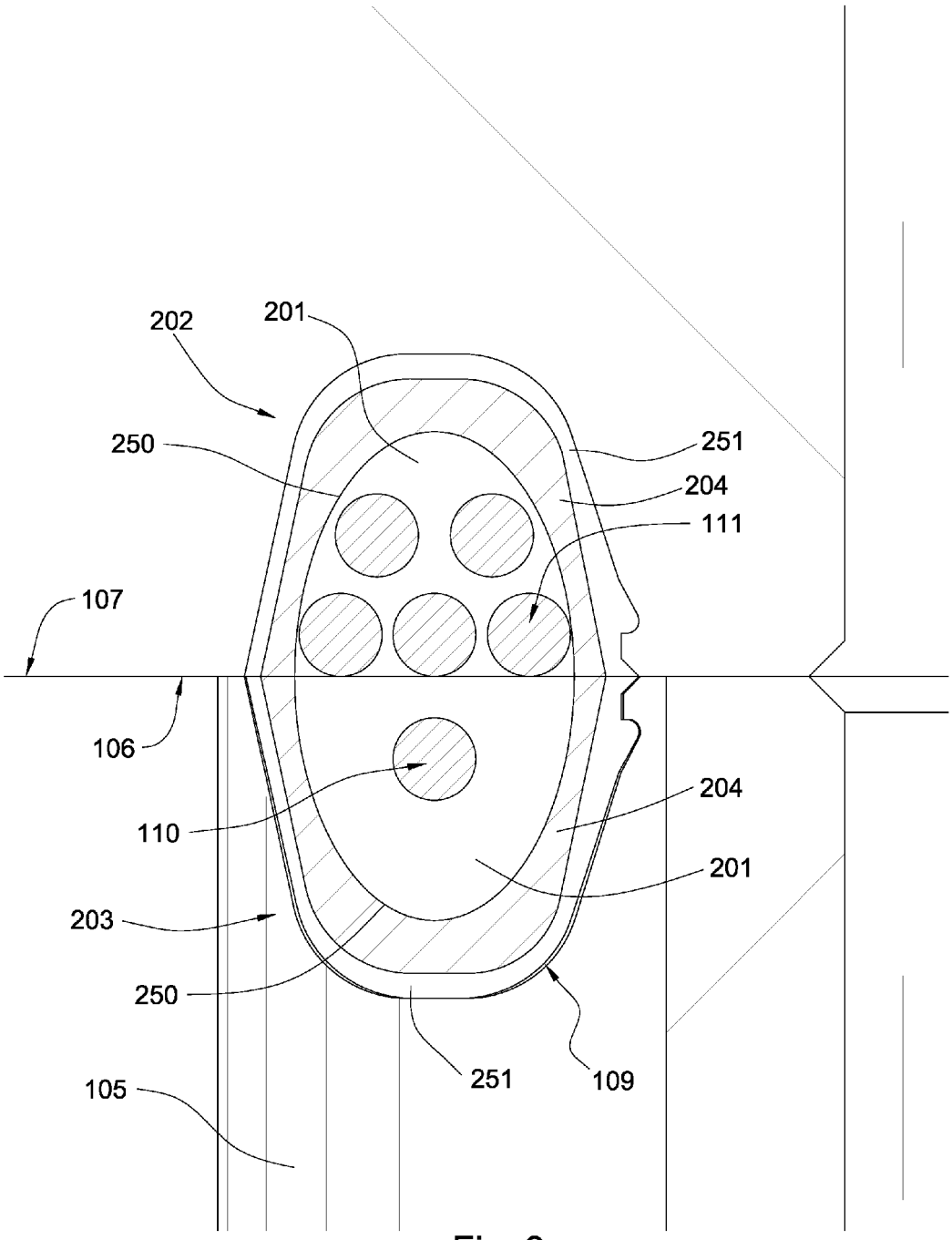
FIG. 3 is a detailed view of FIG. 2.

FIG. 3 is a detailed view 116 of FIG. 2. In this embodiment, first and second inductive couplers 202, 203 may be disposed within the grooves 109 in the shoulders 107, 106. Preferably, grooves comprise with a magnetically conductive, electrically insulating (MCEI) material 204 such as ferrite and form at least one U-shaped trough 250. The MCEI material may also comprise nickel, iron, or combinations thereof. The MCEI material may be disposed within a durable ring 251 of material such as steel or stainless steel. As shown in FIG. 2 the second inductive coupler 203 is in electrical communication with the electrical conductor 105.

Lying within the U-shaped troughs 250 formed in the MCEI material 204 are electrically conductive coils 111, 110. These coils 111, 110 are preferably made from at least one turn of an insulated wire. The wire is preferably made of copper and insulated with a tough, flexible polymer such as high density polyethylene or polymerized tetraflouroethane, though other electrically conductive materials, such as silver or copper-coated steel, can be used to form the coil. The space between the coils 111, 110 and the MCEI material 204 may be filled with an electrically insulating material 201 to protect the coils 111, 110. Also, the inductive couplers 202, 203 are preferably positioned within the shoulders such that when tool string components are joined together, the MCEI material 204 in each coupler 202, 203 contact each other for optimal signal transmission.

The coils 111, 110 are in magnetic communication with each other, allowing an electrical signal passing through one coil 111 to be reproduced in the other coil 110 through mutual inductance. As electric current flows through the first coil 111, a magnetic field 305 in either a clockwise or counterclockwise direction is formed around the coil 111, depending on the direction of the current through the coil 111. This magnetic field 305 produces a current in the second coil 110. Therefore, at least a portion of the current flowing through the first coil 111 is transmitted to the second coil 110. Also, the amount of current transmitted from the first coil 111 to the second coil 110 can be either increased or decreased, depending on the turns ratio between the two coils. A ratio greater than one from the first to the second coil causes a larger current in the second coil, whereas a ratio less than one causes a smaller current in the second coil. In some embodiments, a signal may be transmitted in the opposite direction, from the second coil 110 to the first coil 111. In this direction, a ratio greater than one from the first to the second coil causes a smaller current in the first coil, whereas a ratio less than one causes a larger current in the first coil.

In this manner a power or a data signal may be transmitted from electrical conductor 104 to the first inductive coil 111, which may then be transmitted to the second inductive coil 110 and then to the electrical conductor 105 of the second component 102, or from electrical conductor 105 of the second component 102 to the electrical conductor 104 of the first component 104. The power signal may be supplied by batteries, a downhole generator, another tubular tool string component, or combinations thereof.

Figure 4:
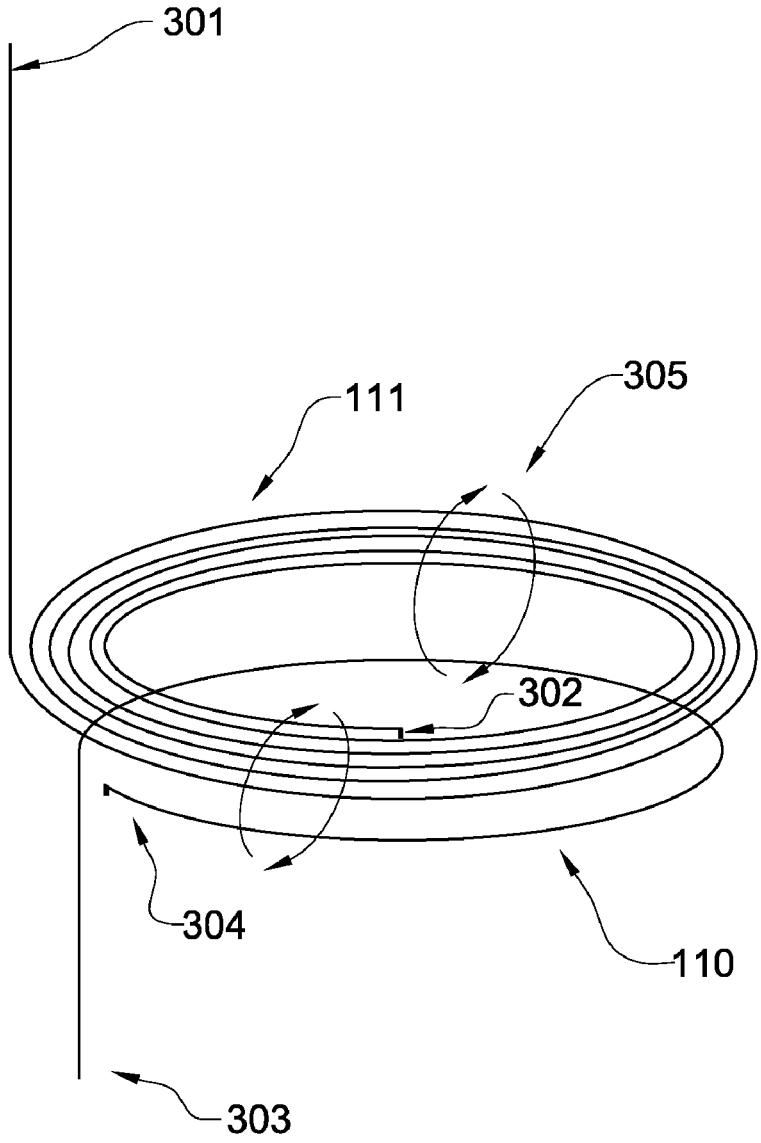
FIG. 4 is a perspective diagram of an embodiment of electrically conducting coils in an inductive coupler.

FIG. 4 is a perspective diagram of an embodiment of electrically conducting coils 111, 110 in an inductive coupler. A first end 301 of the first coil 111 is connected to an electrical conductor, such as a coaxial cable, disposed within the first downhole component, such as electrical conductor 104 of the embodiment disclosed in FIG. 1. A first end 303 of the second coil 110 is connected to another electrical conductor disposed within the second downhole component, such as electrical conductor 105 disclosed in FIG. 1. The first ends 301, 303 of the coils may be inserted into the a coaxial cable such that the coils and a core of the coaxial cable are in electrical communication. Second ends 302, 304 of the first and second coils 111, 110 may be grounded to the durable ring 251, which is in electrical communication with the tool string component. The shield of the coaxial cable may be grounded to the downhole tool string component as well, allowing the component to be part of the electrical return path.

Figure 5:
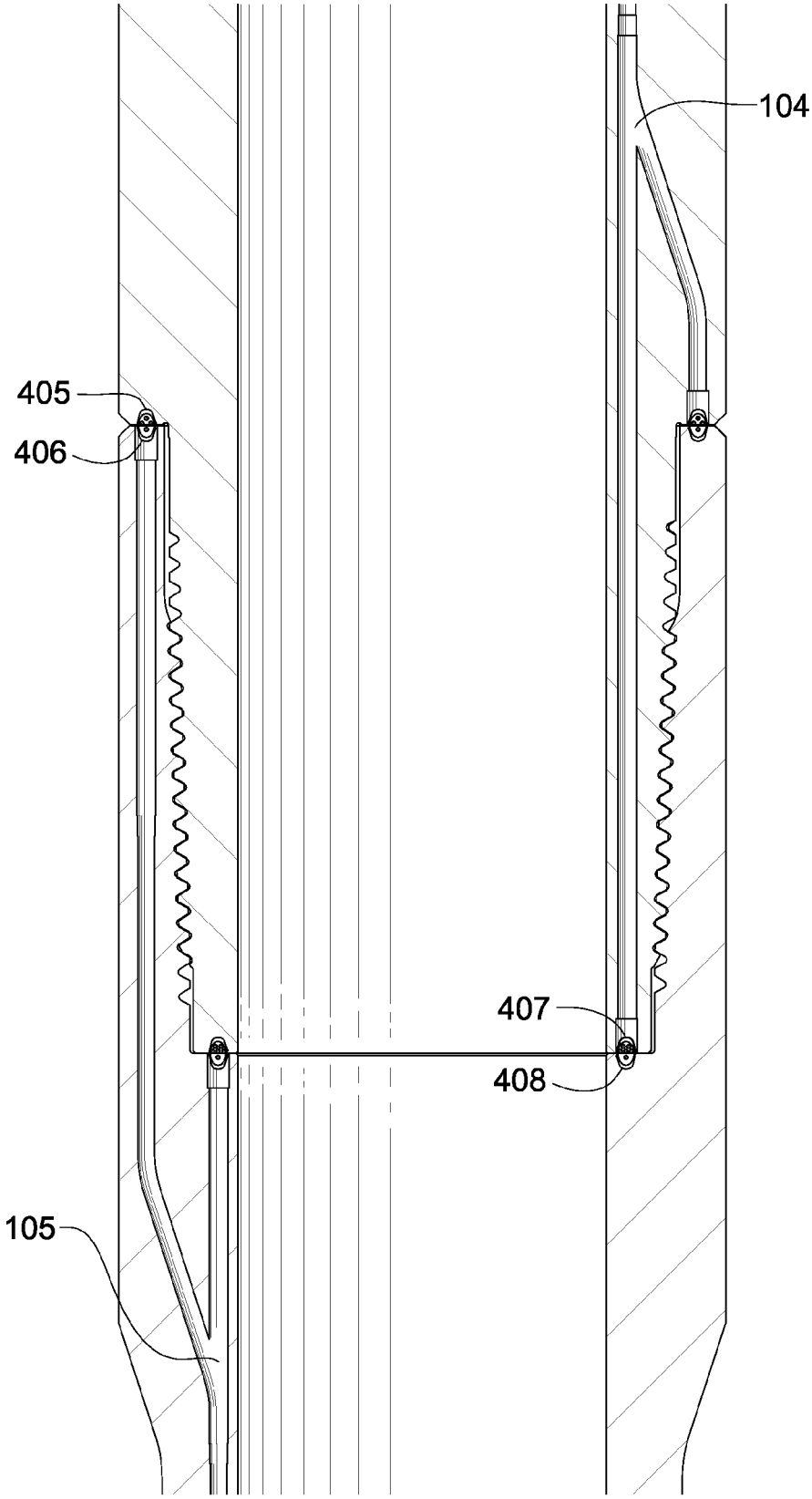
FIG. 5 is a cross sectional diagram of another embodiment of first and second tools threadedly connected.

FIG. 5 discloses another embodiment where each of the tool string components comprise a single electrical conductor 104, 105. The ends of the electrical conductors comprise at least two branches which are adapted to electrically connect separate inductive couplers 405, 407, 406, 408 to the electrical conductors 104, 105.

The electrically conducting coils may be adapted to transmit signals at different optimal frequencies. This may be accomplished by providing the first and second coils with different geometries which may differ in number of turns, diameter, type of material, surface area, length, or combinations thereof. The first and second troughs of the couplers may also comprise different geometries as well. The inductive couplers 405, 406, 407, 408 may act as band pass filters due to their inherent inductance, capacitance and resistance such that a first frequency is allowed to pass at a first resonant frequency formed by the first and third inductive couplers 407, 408, and a second frequency is allowed to pass at a second resonant frequency formed by the second and fourth inductive couplers 405, 406.

Preferably, the signals transmitting through the electrical conductors 104, 105 may have frequencies at or about at the resonant frequencies of the band pass filters. By configuring the signals to have different frequencies, each at one of the resonant frequencies of the couplers, the signals may be transmitted through one or more tool string components and still be distinguished from one another.

Figure 6:
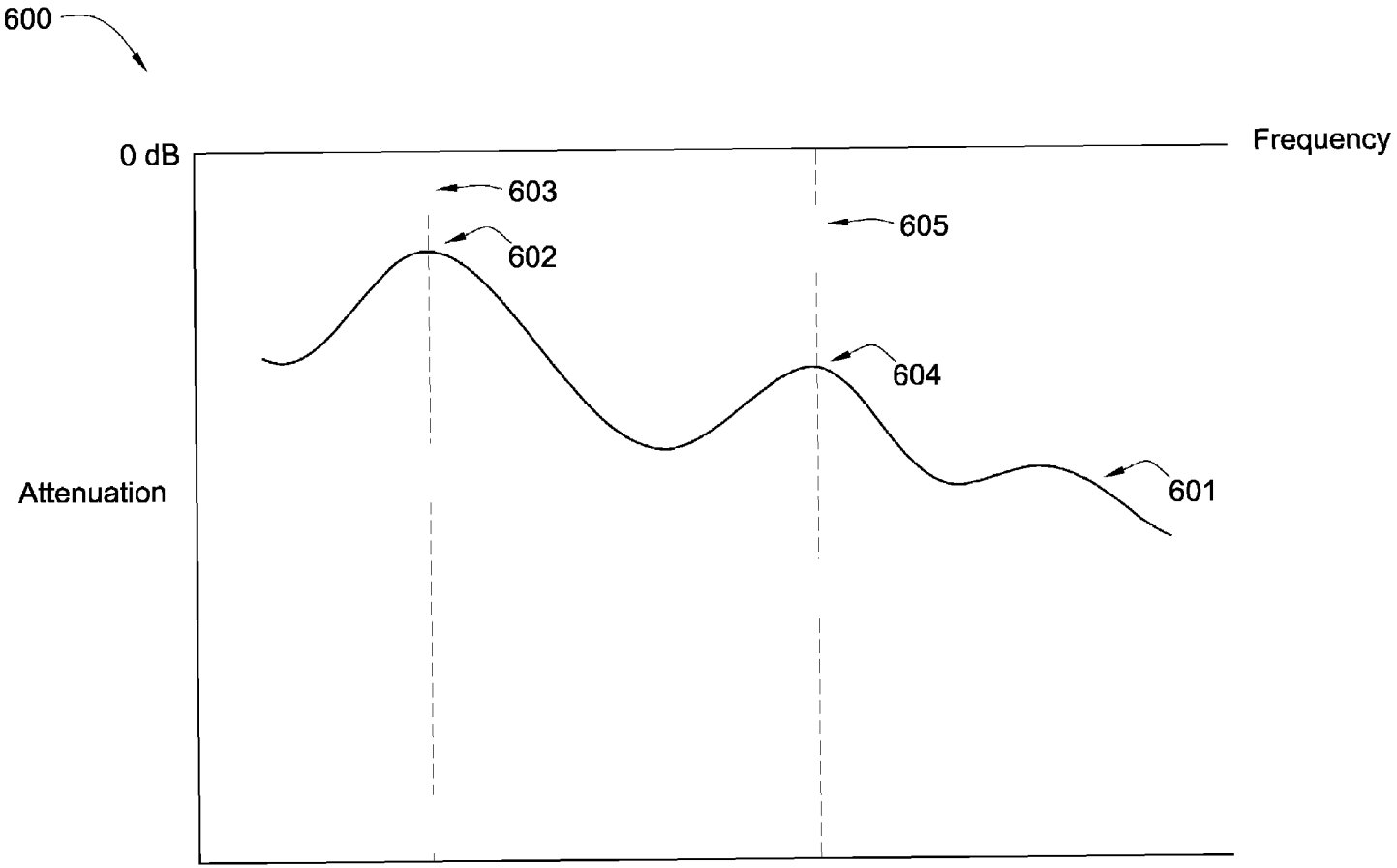
FIG. 6 is an embodiment of a plot of attenuation vs. frequency for a signal trace.

FIG. 6 is an embodiment of a plot 600 of attenuation vs. frequency for a signal trace 601. The trace 601 represents a sample signal traveling through the telemetry system and shows the attenuation that the signal may have at different frequencies due to passing through filters at inductive couplers. A first peak 602 is centered around a lower resonant frequency 603 and a second peak 604 is centered around a higher resonant frequency 605. The lower resonant frequency 603 has less attenuation and therefore produces a stronger signal and may be better for transmitting power than the higher resonant frequency 605. If a power signal is being transmitted, a band pass filter may be designed to have a resonant frequency between 500 kHz and 1 MHz for optimal power transfer.

Figure 7:
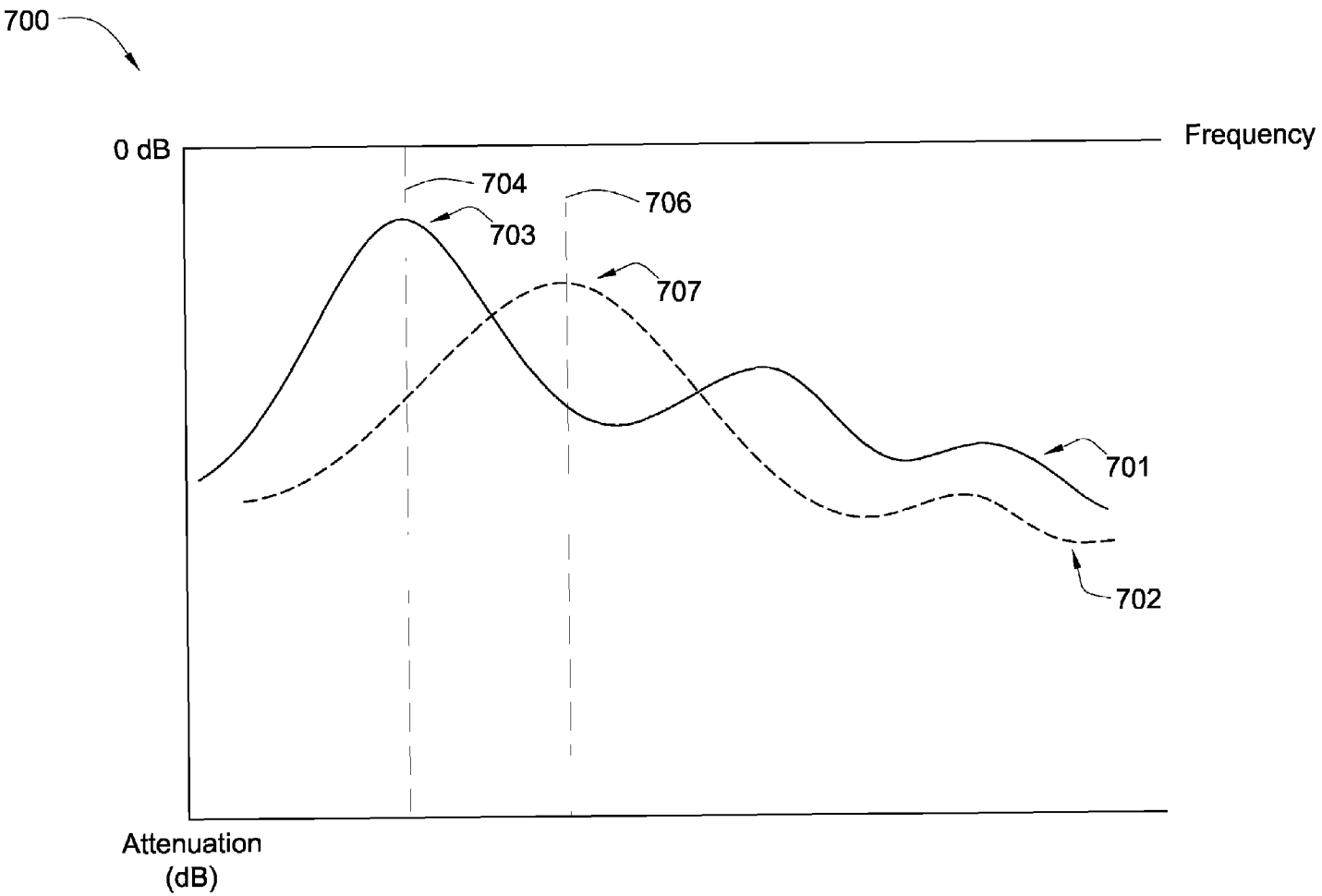
FIG. 7 is an embodiment of a plot of attenuation vs. frequency for two signal traces.

FIG. 7 is a sample plot 700 of two signal traces 701, 702, wherein a first signal trace 701 may be a power signal and a second signal trace 702 may be a data signal. The two signals may be transmitted on the same electrical conductor or on separate conductors. The first trace 701 has a first peak 703 centered around a first lower resonant frequency 704 and the second trace 702 has a second peak 707 centered around a second lower resonant frequency 706. Either signal may transmit power or data; however, power may best transmitted at lower frequencies, while data may be more effectively transmitted at higher frequencies.

Figure 8:
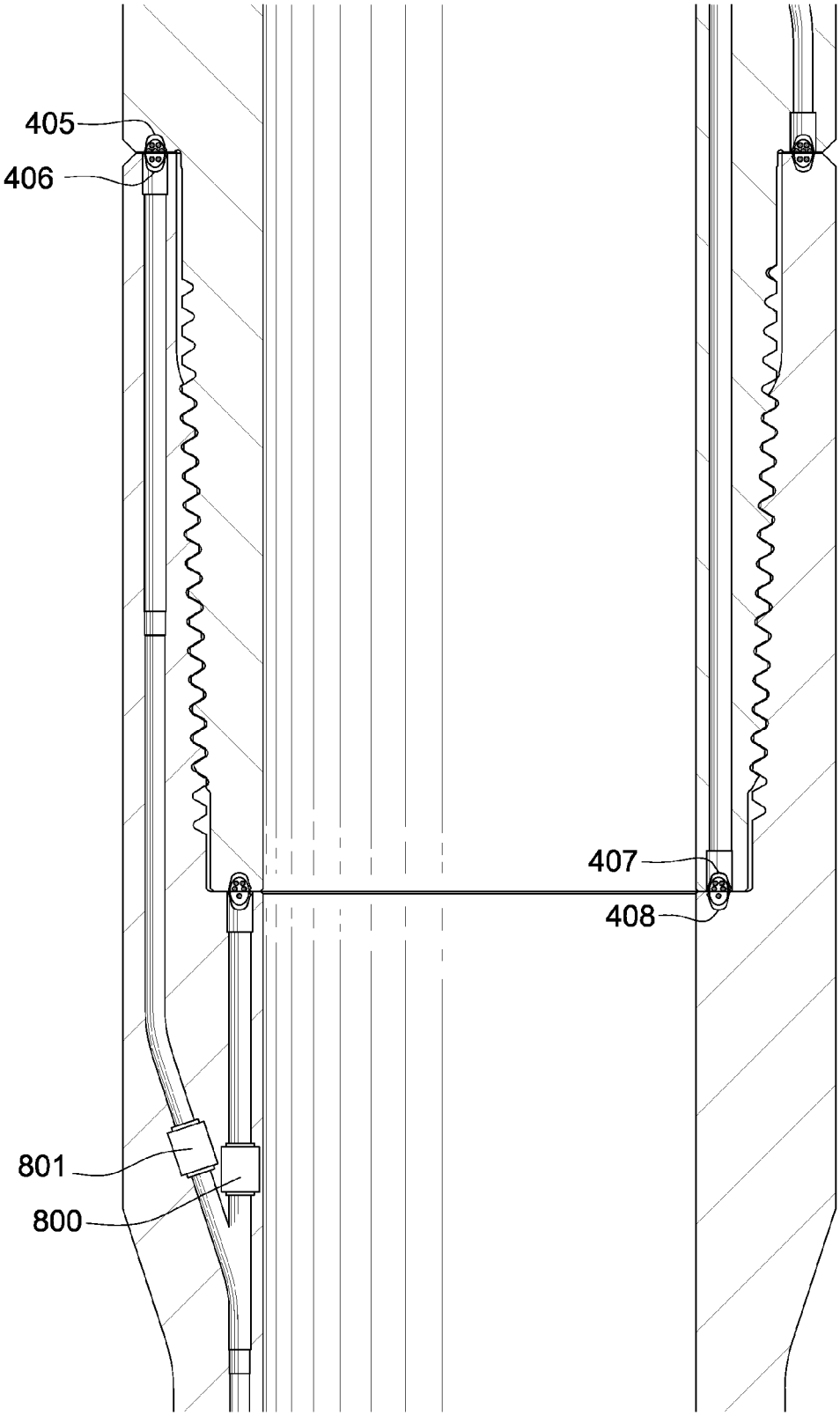
FIG. 8 is a cross-sectional diagram of another embodiment of first and second tools threadedly connected.

In FIG. 5, the inherent characteristics of the inductive couplers 405, 406, 407, 408 filter the signals, whereas in the embodiment of FIG. 8 in-line band pass filters 800, 801 are disclosed. At least one of the in-line filters 800, 801 may comprise inductors, capacitors, resistors, active filters, passive filters, integrated circuit filters, crystal filters, or combinations thereof. The first in-line filter 800 may allow frequencies at or about at a first resonant frequency to pass through, while the second in-line filter 801 may allow frequencies at or about at a second resonant frequency to pass through. The in-line filters 800, 801 may be used to filter a data signal from a power signal, or any combination of power or data signals, or to fine-tune the signals to a narrower bandwidth before reaching the inductive couplers 405, 406, 407, 408.

Figure 9:
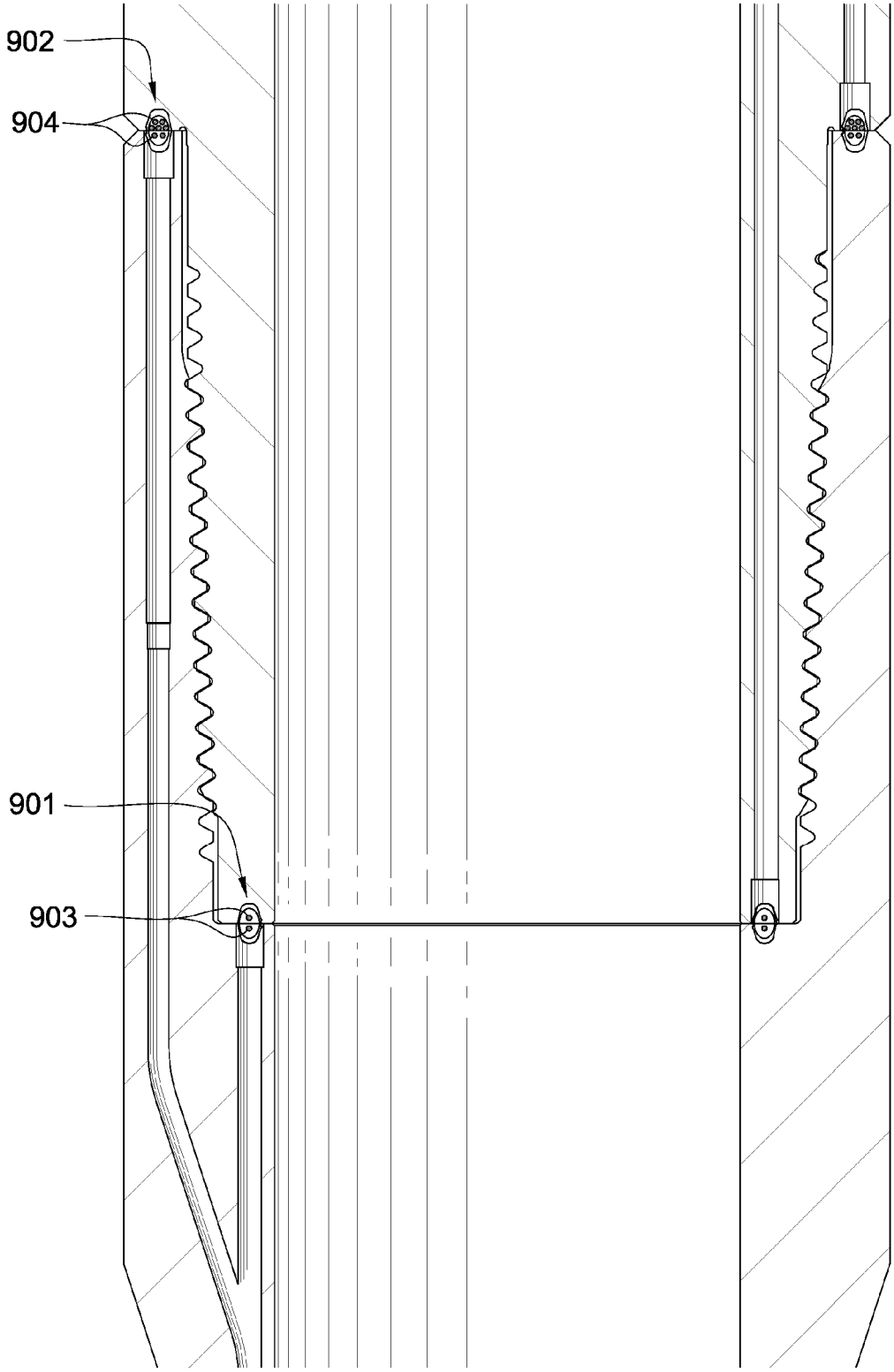
FIG. 9 is a cross-sectional diagram of another embodiment of first and second tools threadedly connected.

FIG. 9 discloses another embodiment of two tool string components threadedly connected, wherein first couplers 901 are specifically designed to pass a data signal, having an equal turns ratio of one to one in coils 903, and second couplers 902 are specifically designed to pass a power signal, having an unequal turns ratio in coils 904.

Figure 10:
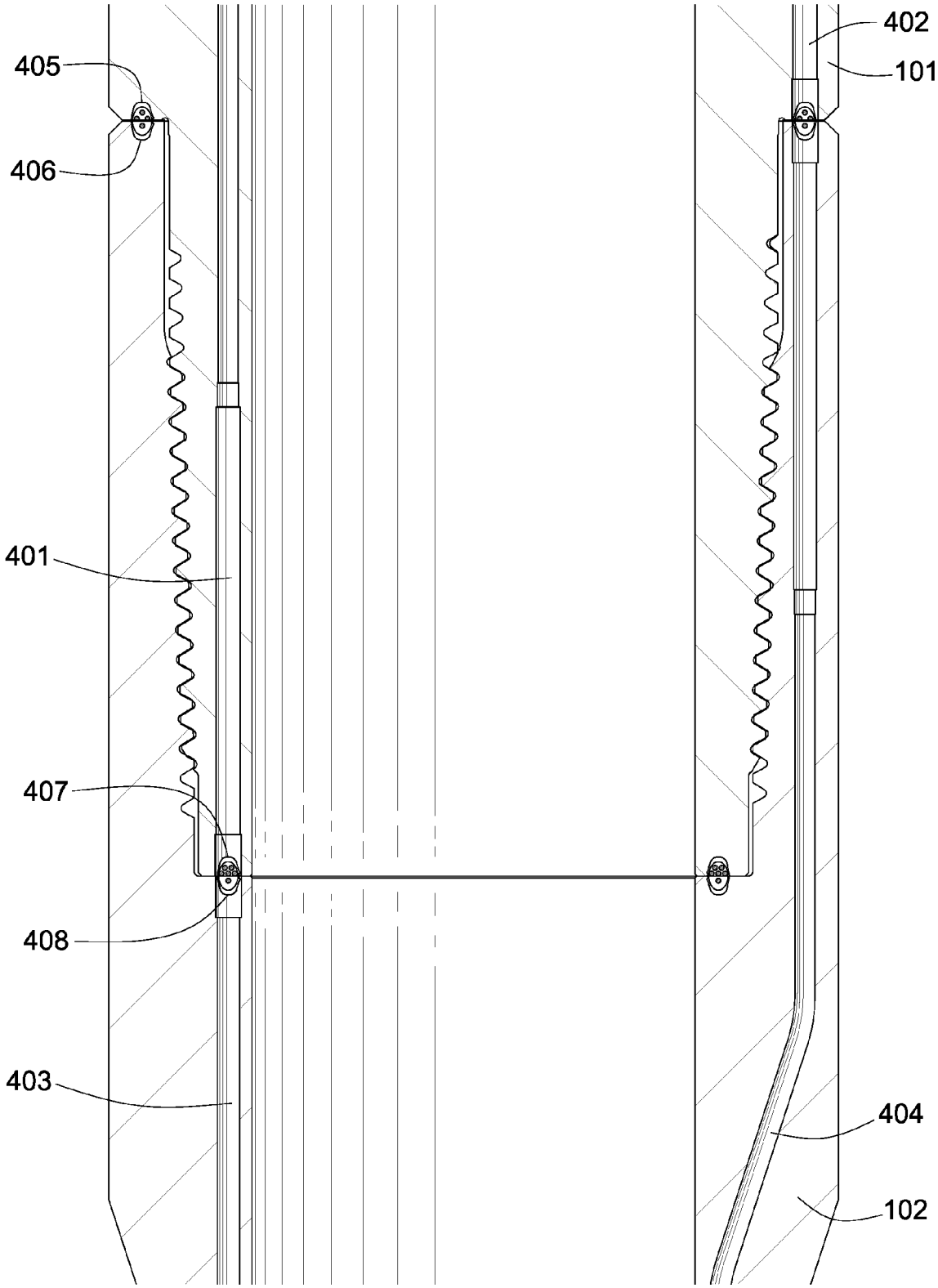
FIG. 10 is a cross sectional diagram of another embodiment of first and second tools threadedly connected.

FIG. 10 discloses another embodiment of the present invention. First and second electrical conductors 401, 402 are disposed within the first tool string component 101 and are in electrical communication with first and second inductive couplers 407, 405, the first coupler 407 being disposed within a groove formed in the secondary shoulder and the second coupler 405 being disposed within a groove formed in the primary shoulder. Similarly, the second tool string component 102 comprises third and fourth electrical conductors 403, 404 with third and forth inductive couplers 406, 408 adapted to communicate with the first and second couplers 407, 405.

An example of when it may be advantageous to have separate electrical conductors in the same tool string component is when two separate signals are being transmitted through the tool string at the same time, such as a data signal and a power signal. The signals may need to be distinguished from one another, and separate electrical conductors may accomplish this. It may also be desired by two separate parties, both desiring to transmit information and/or data through a tool string, to have separate electrical conductors to obtain higher bandwidth or higher security.

Figure 11:
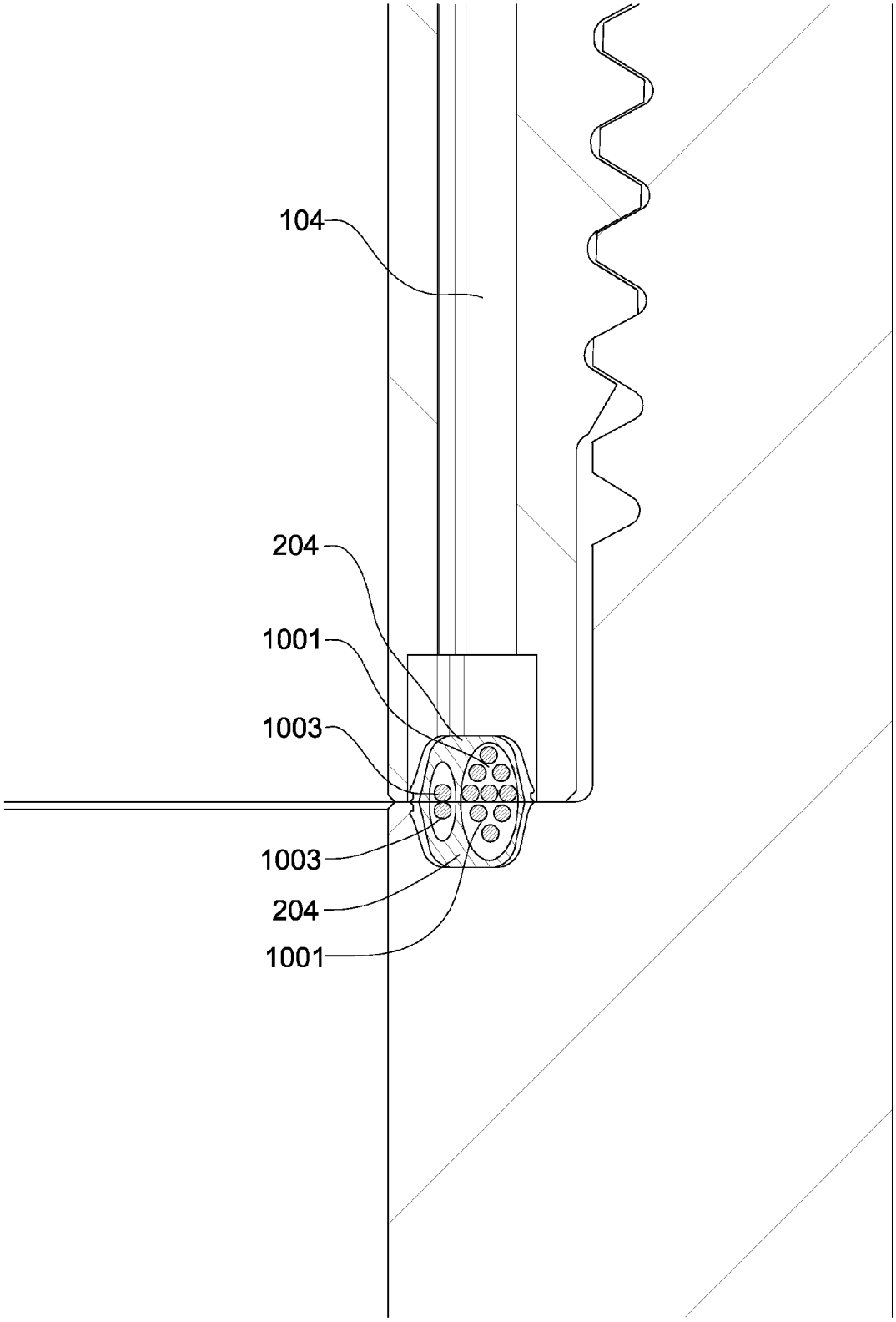
FIG. 11 is a cross sectional diagram of a coupler comprising at least two troughs.

FIG. 11 is a cross-sectional diagram of an embodiment of two pairs of coils 1001, 1003 disposed within different troughs of MCEI material 204 of the same couplers. In this configuration, the geometries of the separate pairs of coils 1001, 1003 and troughs may be designed to have different resonant frequencies 704, 706. Two different signals having different frequencies, each at one of the resonant frequencies 704, 706 of the coils 1001, 1003, may then be transmitted through a single conductor 104. This configuration may be advantageous because having a single coupler disposed within the secondary shoulder of the tool string component may be simpler to manufacture.

Although this embodiment depicts one pair of coils 1003 having the same number of turns, and the other pair of coils 1001 having a different number of turns, any combination of turns and ratios may be used.

Figure 12:
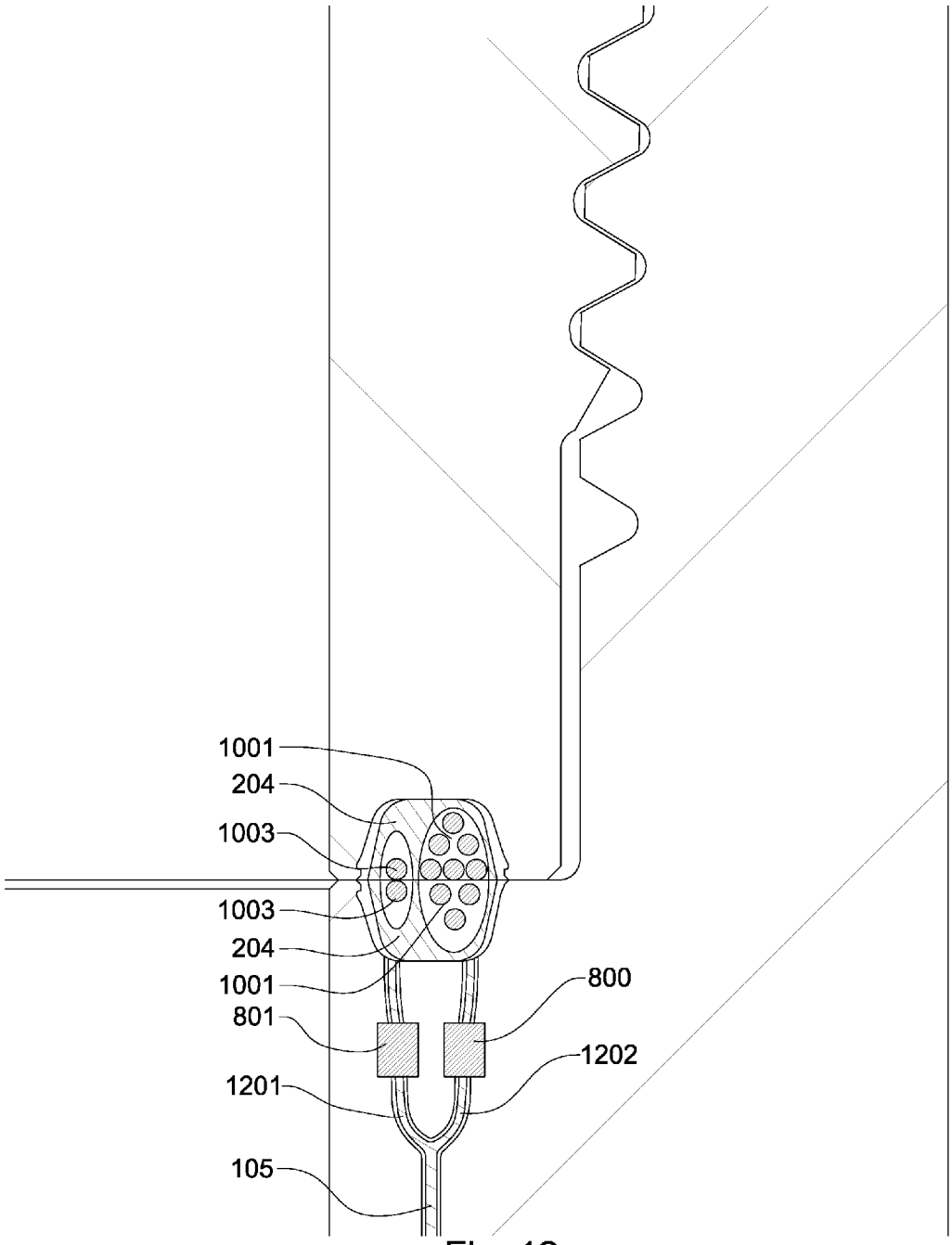
FIG. 12 is a cross sectional diagram of another coupler comprising at least two troughs.

FIG. 12 discloses another embodiment of the present invention comprising in-line filters 800, 801 on branches 1201, 1202 of the electrical conductor 105 which may be used to separate a data signal from a power signal, or any combination of power and/or data signals, or to fine-tune the signals to a narrower bandwidth before reaching the inductive couplers.

Figure 13:
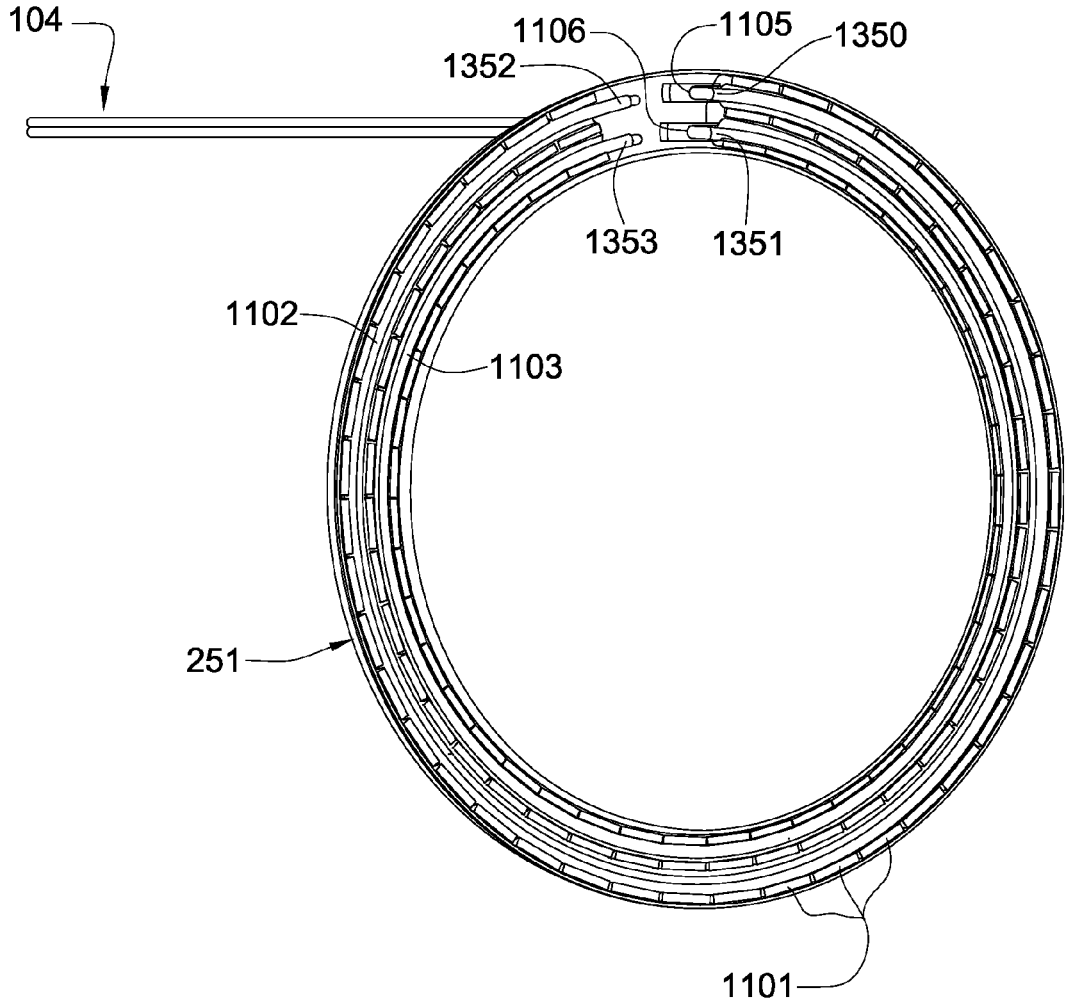
FIG. 13 is a perspective diagram of an embodiment of a pair of coils.

FIG. 13 discloses an embodiment of an inductive coupler 1100 which may be used with the present invention. The coupler may comprise one or more coils 1102, 1103 comprising one or more turns disposed within troughs 250 of MCEI material 204. The MCEI material 204 may comprise a composition selected from the group consisting of ferrite, nickel, iron, mu-metals, and combinations thereof. The MCEI material may be segmented 1101 to prevent eddy currents or simplify manufacturing. One end 1350, 1351 of the coils 1102, 1103 may pass through holes 1105, 1106 and connect to the electrical conductor 104, and the other end 1352, 1353 may be welded to the ring 251 as ground to complete the electrical circuit.

The individual troughs may have different permeabilities which affect the frequencies at which they resonate. The different permeabilities may be a result of forming the individual troughs with different chemical compositions. For example more iron, nickel, zinc or combinations thereof may have a higher concentration proximate either the first or second trough. The different compositions may also affect the Curie temperatures exhibited by each trough.

Figure 15:
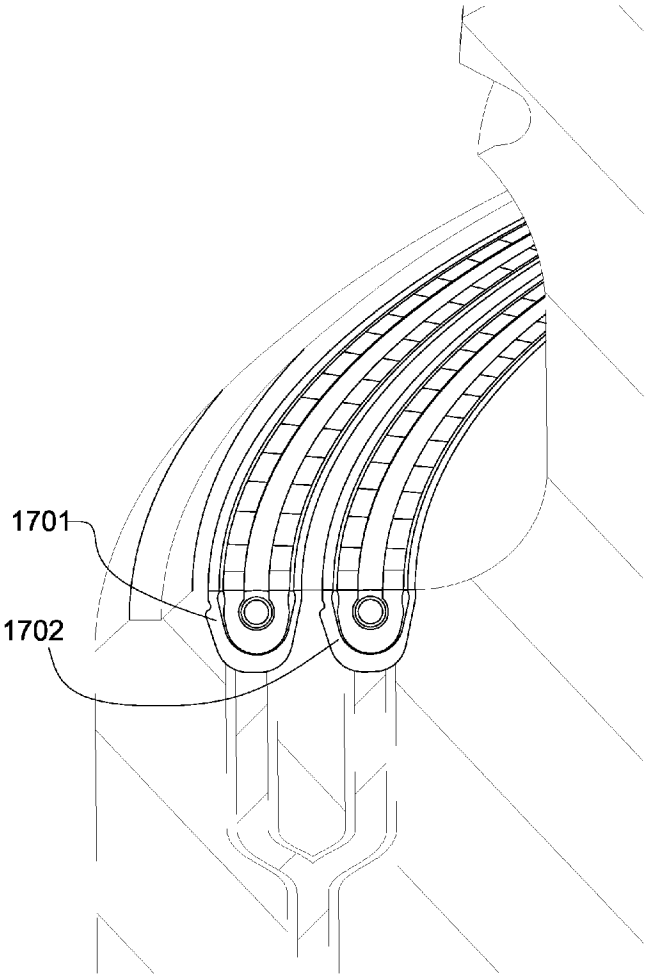
FIG. 15 is a cross sectional diagram of another embodiment of a pair of coils.
Figure 14:
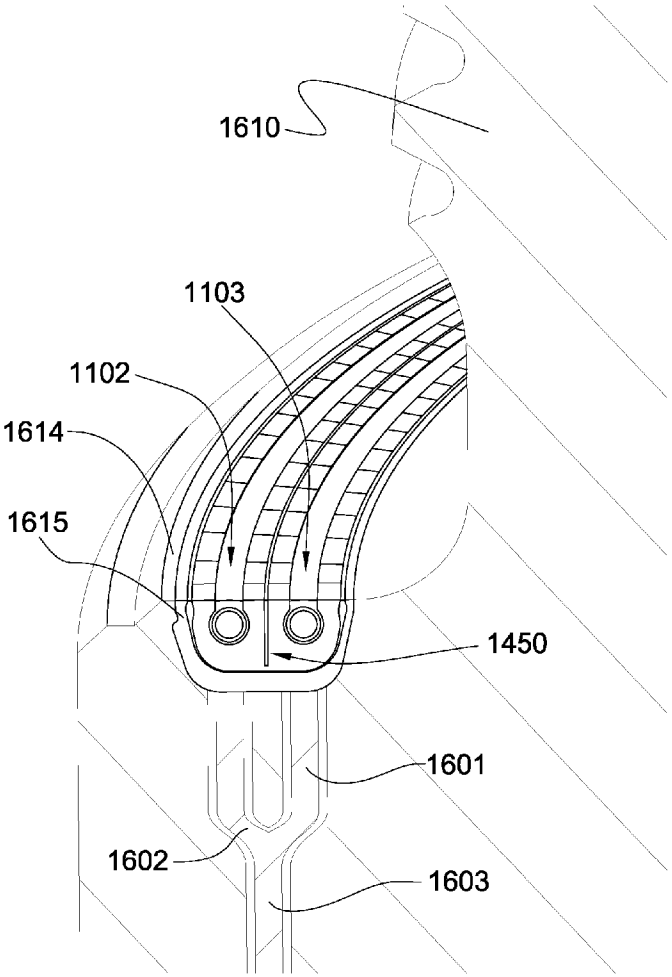
FIG. 14 is a cross sectional diagram of another embodiment of a pair of coils.

FIG. 14 and FIG. 15 are cross-sectional diagrams of a pair of coils 1102, 1103 in a shoulder 1614 of a component 1610. As seen in FIG. 14, coils 1102, 1103 may be disposed within individual troughs 250 of MCEI material disposed within a single ring 1615 and an electrical conductor 1603 may be connected to the coils 1102, 1103 through branches 1602, 1601, respectively. The troughs may be separated by a magnetically insulating material 1450 to prevent interference between the magnetic fields produced. Alternatively, the coils 1102, 1103 may be in troughs of MCEI material in separate rings 1701, 1702 as in FIG. 15.

Figure 16:
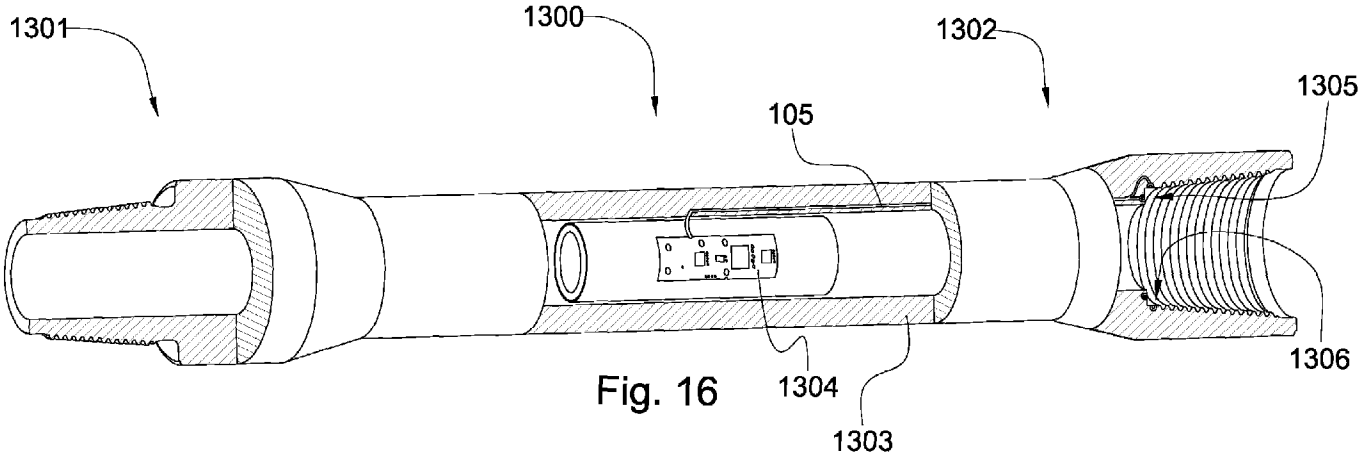
FIG. 16 is cut away diagram of an embodiment of electronic equipment disposed within a tool string component.
Figure 17:
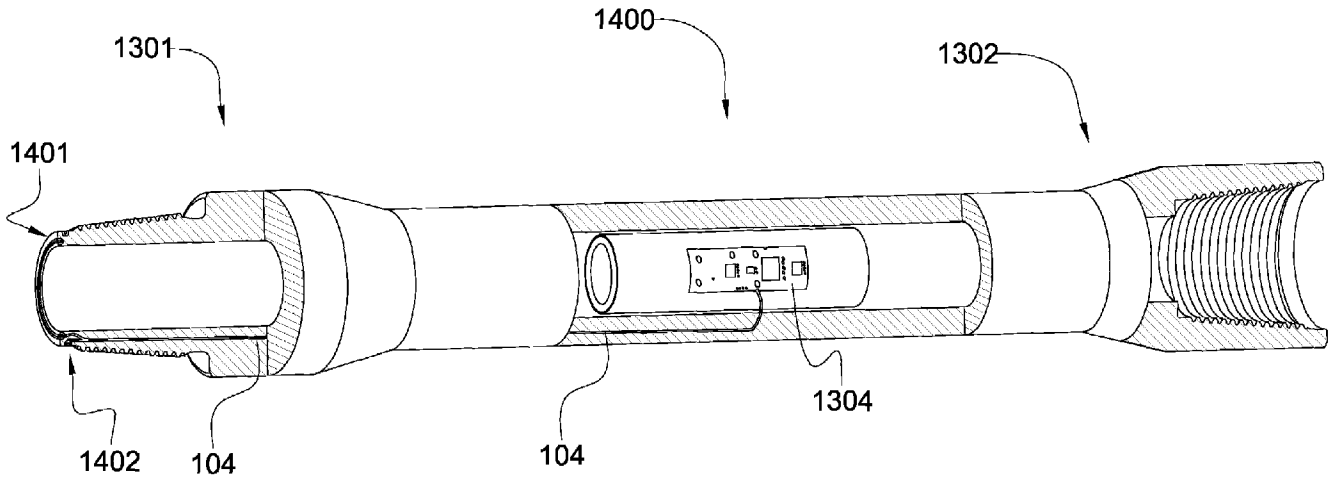
FIG. 17 is cut away diagram of another embodiment of electronic equipment disposed within a tool string component.

Referring to FIGS. 16 and 17 collectively, components 1300, 1400 comprise electronic equipment 1304. In FIG. 13 a box end 1302 comprises a plurality of inductive couplers 1305, 1306 and the component further comprises an electrical conductor 105 in the body 1303 of the component 1300. The electrical conductor connects the inductive couplers 1305, 1306 to the electronic equipment 1304. The pin end is free of signal couplers which may be advantageous in situations where the component 1300 needs to communicate in only one direction. FIG. 17 shows a pin end 1301 comprising a plurality of couplers 1401, 1402 connected by an electrical conductor 104 to the electronic equipment 1304.

The electronic equipment 1304 may be inclinometers, temperature sensors, pressure sensors, or other sensors that may take readings of downhole conditions. Information gathered by the electronic equipment 1304 may be communicated to the drill string through the plurality of inductive couplers in the box end 1301 through a single electrical conductor 105. Also, power may be transmitted to the electronic equipment 1304 from a remote power source.

The electronic equipment 1304 may comprise a router, optical receivers, optical transmitters, optical converters, processors, memory, ports, modem, switches, repeaters, amplifiers, filers, converters, clocks, data compression circuitry, data rate adjustment circuitry, or combinations thereof.

Figure 18:
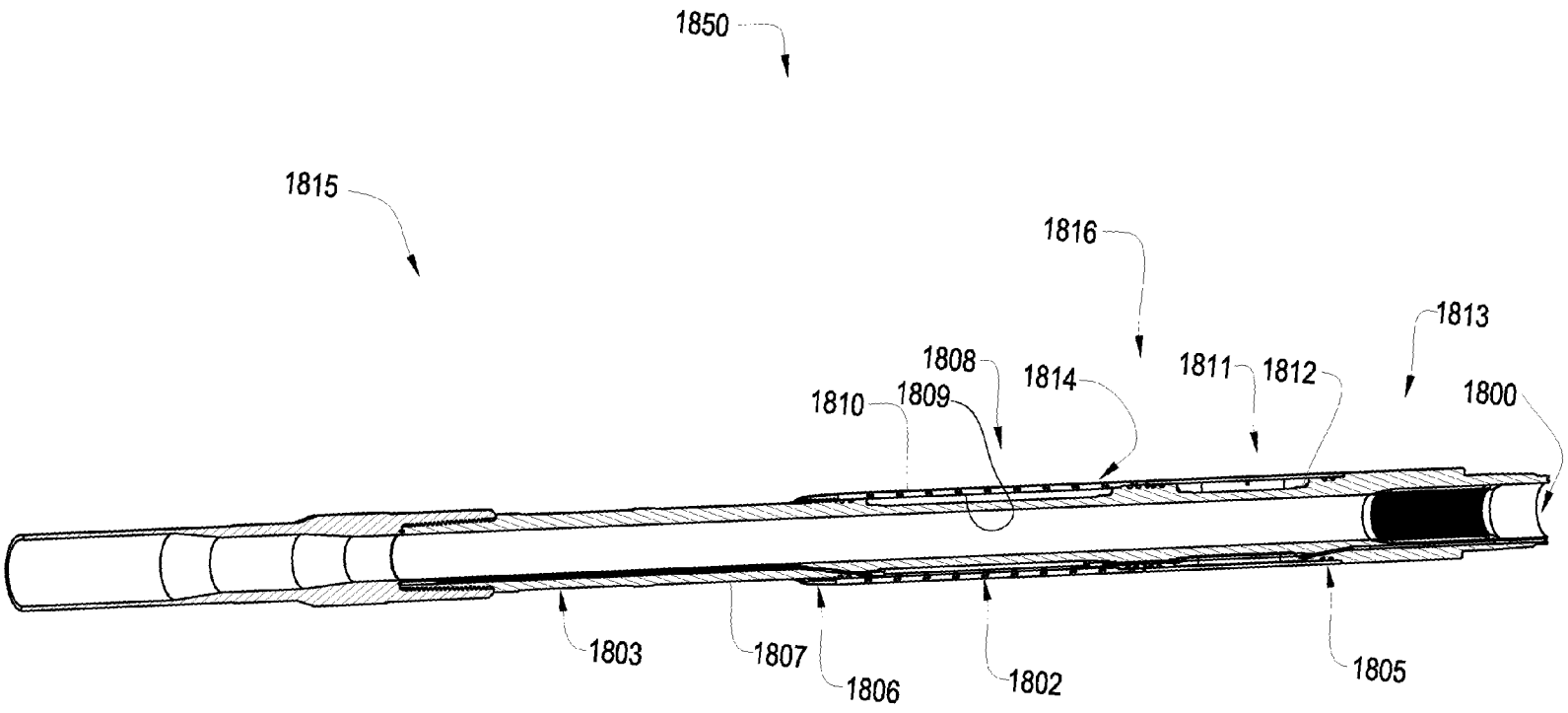
FIG. 18 is a cross-sectional diagram of an embodiment of a tool string component with a sleeve secured to its outer diameter.
Figure 19:
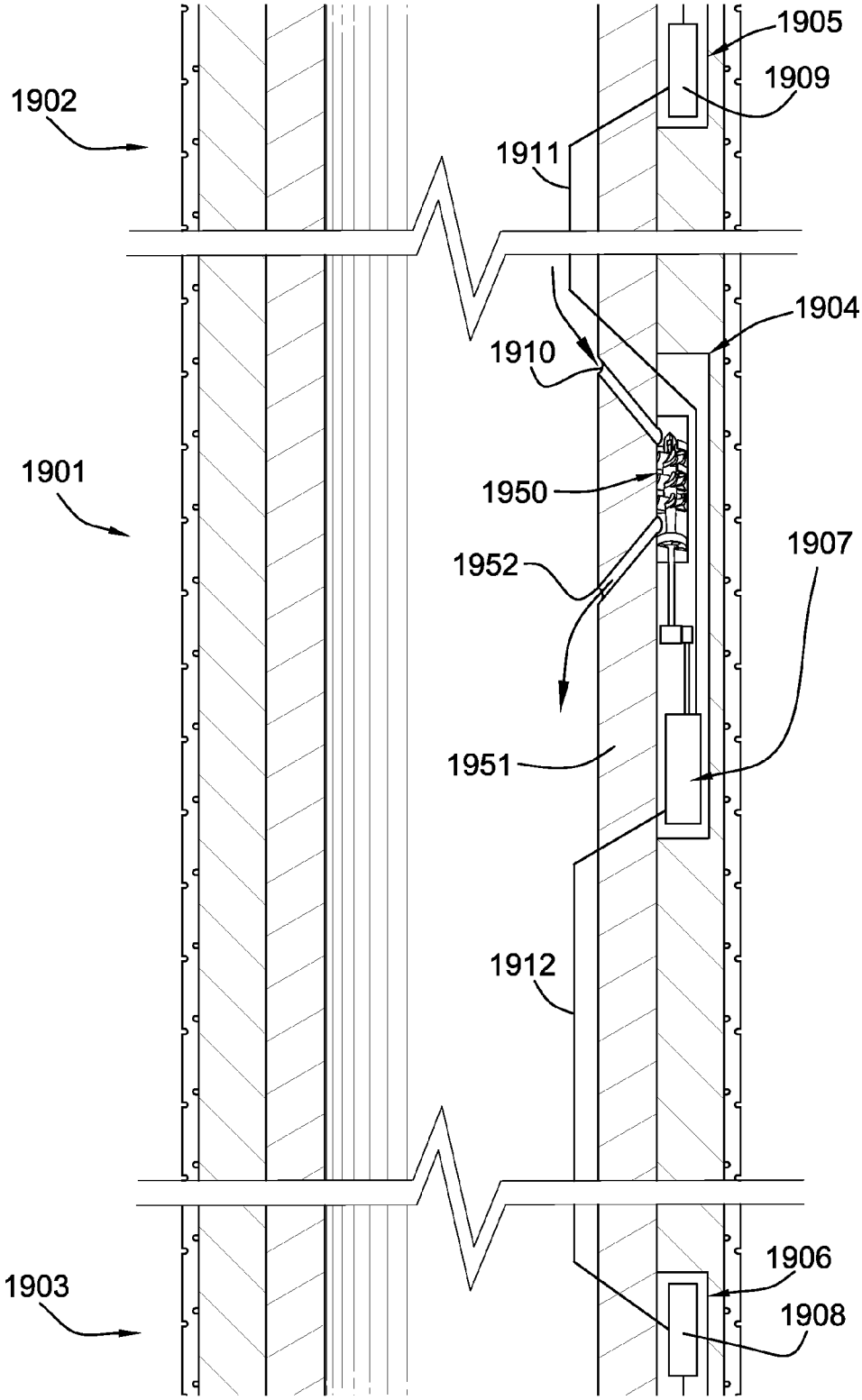
FIG. 19 is a cross-sectional diagram of an embodiment of tool string components comprising an electrical generator.

FIG. 18 is a cross-sectional diagram of an embodiment of downhole tool string component 1850. A compliant covering 1802 is coaxially secured at a first end 1805 and a second end 1806 to an outside diameter 1807 of the tubular body 1803. The covering 1802 may comprise at least one stress relief groove 1808 formed in an inner surface 1809 and an outer surface 1810 of the covering 1802. A closer view of the stress relief grooves 1808 is shown in FIG. 19 for clarity.

As shown there is at least one enclosure formed between the covering 1802 and the tubular body 1803. The first enclosure 1811 is partially formed by a recess 1812 in an upset region 1813 of the first end 1800 of the tubular body 1803. A second enclosure 1814 is also formed between the covering 1802 and the tubular body 1803. Electronic equipment may be disposed within the enclosures to process data or generate power to be sent to other components in the tool string.

The covering 1802 may be made of a material comprising beryllium cooper, steel, iron, metal, stainless steel, austenitic stainless steels, chromium, nickel, cooper, beryllium, aluminum, ceramics, alumina ceramic, boron, carbon, tungsten, titanium, combinations, mixtures, or alloys thereof. The compliant covering 1802 is also adapted to stretch as the tubular body 1803 stretches. The stress relief grooves' 1808 parameters may be such that the covering 1802 will flex outward a maximum of twice its width under pressure. Preferably, the compliant covering 1802 may only have a total radial expansion limit approximately equal to the covering's thickness before the covering 1802 begins to plastically deform. The tool string component 1850 as shown in FIG. 18 has a first section 1815 and a second section 1816, where the covering 1802 is attached to the second section 1816. Preferably the covering 1802 has a geometry which allows the second section 1816, with the covering 1802 attached, to have substantially the same compliancy as the first section 1815.

The tool string component 1850 preferably comprises a seal between the covering 1802 and the tubular body 1803. This seal may comprise an O-ring or a mechanical seal. Such a seal may be capable to inhibiting fluids, lubricants, rocks, or other debris from entering into the enclosures 1811 or 1814. This may prevent any electronic equipment disposed within the enclosures from being damaged.

FIG. 19 discloses three components 1901, 1902, 1903 of the tool string, each comprising a covering similar to the covering 1802 disclosed in the embodiment of FIG. 18, wherein each sleeved enclosure 1904, 1905, 1906 comprises electronic equipment 1907, 1908, 1909 which may comprise power sources, batteries, generators, circuit boards, sensors, seismic receivers, gamma ray receivers, neutron receivers, clocks, caches, optical transceiver, wireless transceivers, inclinometers, magnetometers, digital/analog converters, digital/optical converters, circuit boards, memory, strain gauges, temperature gauges, pressure gauges, actuators, and combinations thereof.

The electronic equipment 1907, 1908, 1909 may be in electrical communication with each other through electrical conductors 1911, 1912. The electrical conductors 1911, 1912 may transmit a data signal and a power signal, two data signals, or two power signals. Preferably, the electrical conductors 1911, 1912 are in communication with the couplers of the present invention and are adapted to transmit data and/or power signals.

An electric generator 1950, such as a turbine, may be disposed within one of the enclosures between the tubular body of the tool string component and the covering. In embodiments where the electronic equipment 1907 comprises a turbine, fluid may be in communication with the turbine through a bored passage 1910 in the tool string component's wall 1951. A second passage 1952 may vent fluid away from the turbine and back into the bore 1953 of the component. In other embodiments, the fluid may be vented to the outside of the tool string component by forming a passage in the covering 1802. The generated power may then be transmitted to other tool string components 1902, 1903 through the inductive couplers of the present invention. The generator may provide power to the electronic equipment disposed within the tool string component. In some embodiments of the present invention, such as in the bottom hole assembly, electronic equipment may only be disposed within a few tool string components and power transmission over the entire tool string may not be necessary. In such embodiments, the couplers of the present invention need not be optimized to reduce all attenuation since the power signals will only be transmitted through a few joints. The power generated in component 1901 may be transmitted to both the components 1902 or 1903, or it may only need to be transmitted to one or the other.

Figure 20:
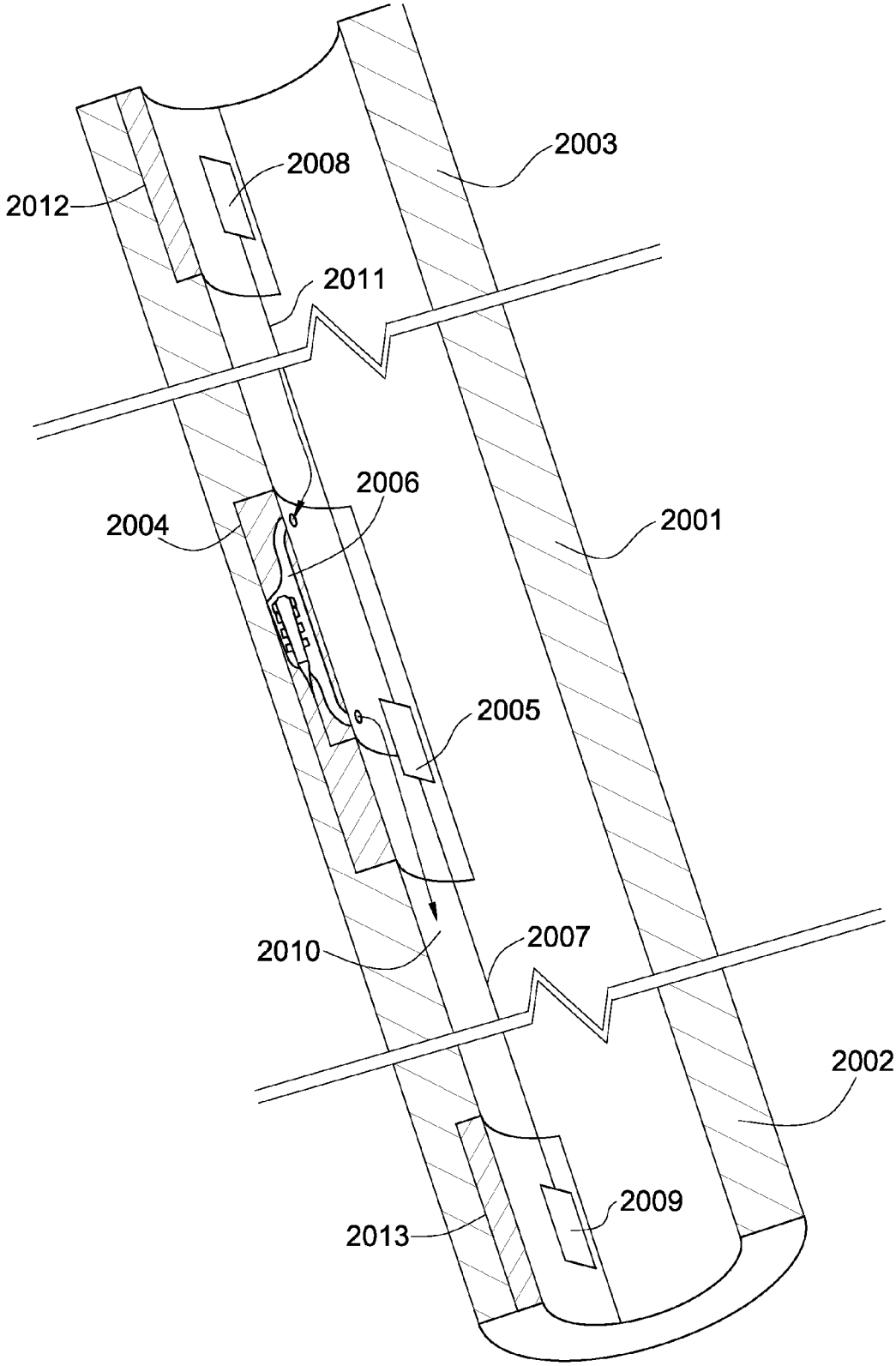
FIG. 20 is a cross-sectional diagram of another embodiment of tool string components comprising an electrical generator.

FIG. 20 is another embodiment of a plurality of tool string components 2001, 2002, 2003 which are connected and in electrical communication with each other through electrical conductors 2011, 2007. The tool string components may be thick walled components such as drill collars or heavy weight pipe. Each electrical conductor 2007, 2011 may transmit data and/or power signals. In this embodiment, electronic equipment 2005, 2008, 2009 is disposed within recesses 2004, 2012, 2013 in bores of the tool string components 2001, 2002, 2003.

The electric generator 1950 may also be disposed within the component 2001 and be adapted to provide power of the electronic equipment in the adjacent components 2002, 2003

Figure 21:
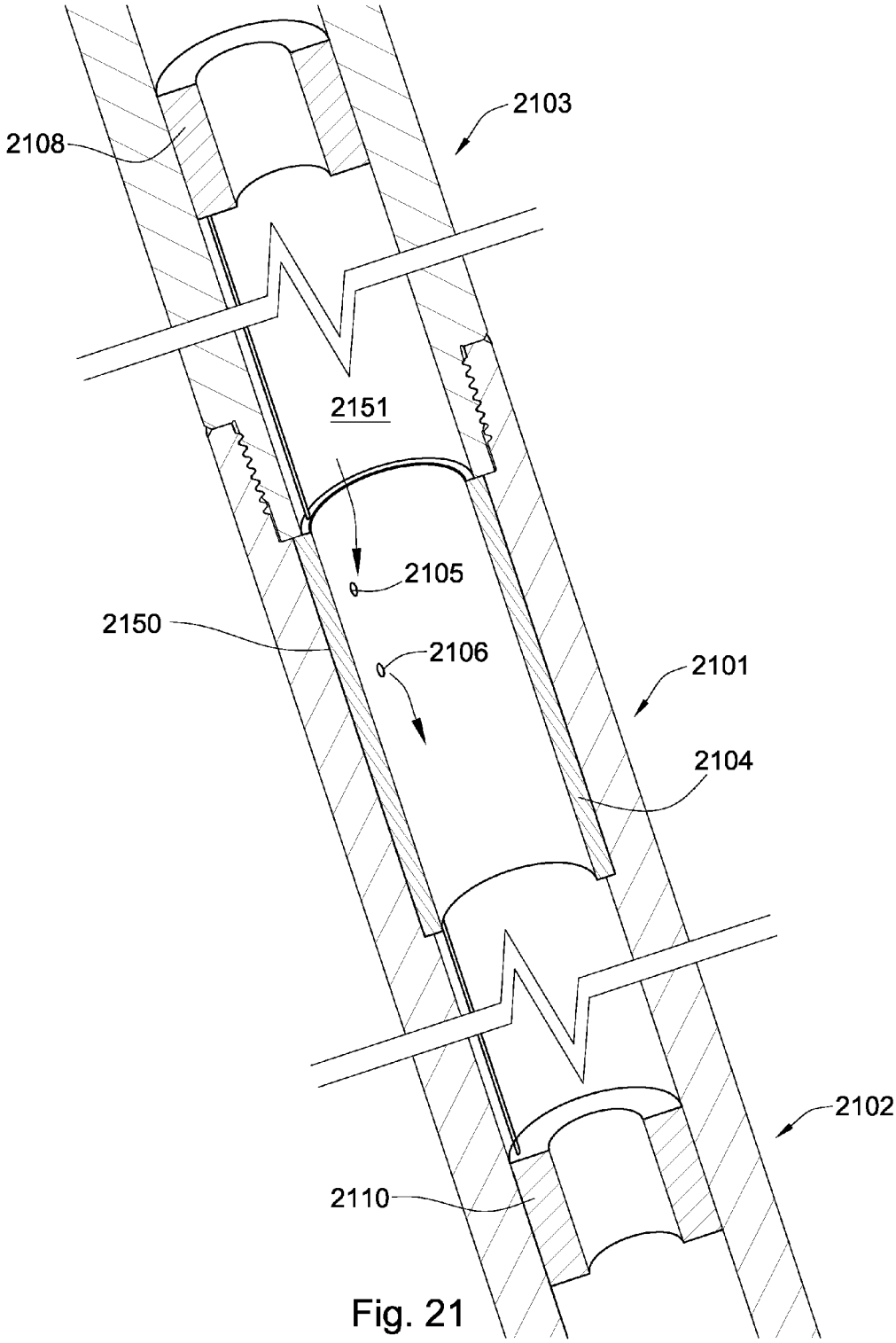
FIG. 21 is a cross-sectional diagram of another embodiment of tool string components comprising an electrical generator.

FIG. 21 is a cross sectional diagram of another embodiment wherein electronic equipment is disposed within a recess 2150 formed in the bore 2151 of tool string components 2101. The first tool string component 2101 comprises electronic equipment 2104 disposed within the recess 2150. Electronic equipment 2108, 2110 is also disposed within the bores of the second and third tool string components 2103, 2102. In order to insert the electronic equipment within the bore 2151, the component 2101 may be cut in two. The two pieces may be threaded to reconnection. Such a system of retaining the electronic equipment in component 2101 is disclosed in U.S. Patent Publication 20050161215, which is herein incorporated by reference for all that it discloses.

Figure 22:
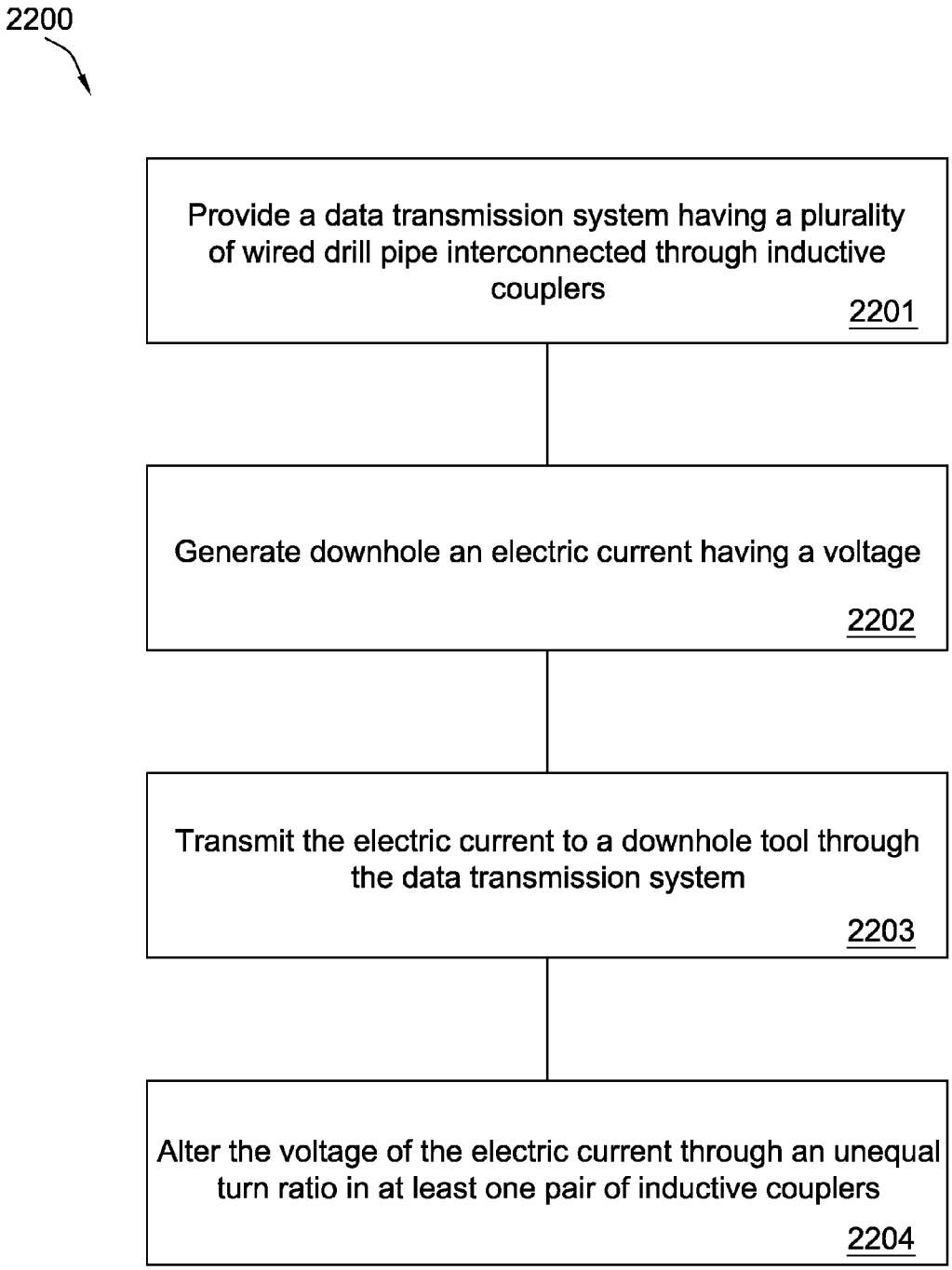
FIG. 22 is a flowchart of an embodiment of a method of transmitting power through a downhole network.

FIG. 22, discloses a method 2200 for transmitting power through a tool string. The method 2200 includes a step for providing 2201 a data transmission system having a plurality of wired drill pipe interconnected through inductive couplers. The method further includes generating 2202 downhole an electric current having a voltage and transmitting 2203 the electric current to a downhole tool through the data transmission system. The voltage of the electric current is then altered 2204 through an unequal turn ratio in at least one pair of inductive couplers. The altered electric current may be used to power electronic equipment downhole.

Whereas the present invention has been described in particular relation to the drawings attached hereto, it should be understood that other and further modifications apart from those shown or suggested herein, may be made within the scope and spirit of the present invention.

What is claimed is:

1. An apparatus comprising:

a downhole tool string component having first and second ends;

the first end comprising first and second signal couplers;

the second end comprising third and fourth signal couplers;

an electrical conductor in electrical communication with the first, second, third, and fourth signal couplers;

wherein the first and third signal couplers comprise a first band pass filter with a first resonant frequency and the second and fourth signal couplers comprise a second band pass filter with a second resonant frequency.

2. The apparatus of claim 1, wherein the signal couplers are inductive couplers.

3. The apparatus of claim 1, wherein the inductive couplers are disposed within a magnetically conducting, electrically insulating trough.

4. The apparatus of claim 1, wherein the apparatus is adapted to transmit a data signal from the first signal coupler through the electrical conductor to the second signal coupler.

5. The apparatus of claim 4, wherein the data signal is transmitted on a carrier signal at or about at the first resonant frequency.

6. The apparatus of claim 1, wherein the apparatus is adapted to transmit a power signal from the third signal coupler through the electrical conductor to the fourth signal coupler.

7. The apparatus of claim 6, wherein a downhole generator supplies the power signal.

8. The apparatus of claim 6, wherein the power signal is transmitted at or about at the second resonant frequency.

9. The apparatus of claim 1, wherein at least one of the band pass filters comprises at least one of the circuit elements of the group consisting of inductors, capacitors, active filters, passive filters, integrated circuit filters, and combinations thereof.

10. The apparatus of claim 1, wherein independent data signals are transmitted from the first and second inductive couplers through the electrical conductor to the third and fourth inductive couplers, respectively.

11. The apparatus of claim 1, further comprising electronic circuitry disposed within the downhole component and in communication with the electrical conductor.

12. A downhole tool, comprising:

a groove formed proximate an end of the downhole tool;

a magnetically conducting, electrically insulating material comprising a first and second trough;

a first electrically conductive coil disposed within the first trough comprising a first geometry adapted to transmit a signal at a first optimal frequency; and a second electrically conductive coil disposed within the second trough comprising a second geometry adapted to transmit a signal within a second optimal frequency.

13. The downhole tool of claim 12, wherein the first and second geometries substantially differ in their number of turns, diameter, type of material, surface area, length or combinations thereof.

14. The downhole tool of claim 12, wherein the downhole tool is drill pipe, production pipe, a drill collar, a heavy weight pipe, reamer, a bottom-hole assembly component, tool string component, a jar, a hammer, swivel, drill bit, a sensor, a sub, or combinations thereof.

15. The downhole tool of claim 12, wherein the first and second troughs comprise different diameters and/or depths.

16. The downhole tool of claim 12, wherein the magnetically conductive, electrically insulating material proximate the first trough comprises a different permeability than the magnetically conductive, electrically insulating material proximate the second trough.

17. The downhole tool of claim 12, wherein an electrical conductor is disposed axially within a bore of the downhole tool and is in electrical communication with both the first and second electrically conductive coils.

18. A downhole tool string, comprising:

a first wired tool string component comprising a first inductive coupler proximate a pin end and a second wired tool string component comprising a second inductive coupler proximate a box end; the pin end of the first component being threadedly connected within the box end of the second component such that the first and second inductive couplers are adjacent one another;

each coupler having a magnetically conductive material with a first coil disposed within a first trough formed in the magnetic material and a second coil disposed within a second trough also formed in the magnetic material; and the first coils of both the pin and box ends comprising a first geometry adapted to transmit a signal at a first frequency and the second coils of both the pin and box ends comprise a second geometry adapted to transmit signals at a different frequency.

19. The downhole tool string of claim 18, wherein the first wired component comprises a power source.

20. The downhole tool string of claim 19, wherein an electrical device disposed within the second wired component is in communication with the power source through the first coils, the second coils or combinations thereof.

* * * * *